US009266632B1

(12) United States Patent
Anderson et al.

(10) Patent No.: US 9,266,632 B1
(45) Date of Patent: Feb. 23, 2016

(54) SPLIT/SPLITTABLE RETAIL READY PACKAGE

(75) Inventors: Vernon J. Anderson, Alexandria, MN (US); Gerald R. Kluver, Alexandria, MN (US)

(73) Assignee: Douglas Machine Inc., Alexandria, MN (US)

( * ) Notice: Subject to any disclaimer, the term of this patent is extended or adjusted under 35 U.S.C. 154(b) by 754 days.

(21) Appl. No.: 13/486,309

(22) Filed: Jun. 1, 2012

Related U.S. Application Data

(60) Provisional application No. 61/515,403, filed on Aug. 5, 2011.

(51) Int. Cl.

| | |
|---|---|
| ***B65B 17/02*** | (2006.01) |
| ***B65B 35/30*** | (2006.01) |
| ***B65B 61/02*** | (2006.01) |
| ***B65B 61/12*** | (2006.01) |
| *B65D 71/42* | (2006.01) |
| *B65B 11/00* | (2006.01) |
| *B65B 11/08* | (2006.01) |

(52) U.S. Cl.
CPC ..... *B65B 17/02* (2013.01); *B65B 35/30* (2013.01); *B65B 61/02* (2013.01); *B65B 61/12* (2013.01); *B65B 11/004* (2013.01); *B65B 11/08* (2013.01); *B65D 71/42* (2013.01)

(58) Field of Classification Search
CPC ..... B65B 17/02; B65B 5/024; B65B 5/026; B65B 61/02; B65B 61/12; B65B 53/00; B65B 53/02; B65B 35/30; B65B 11/004; B65B 11/08; B65D 5/4266; B65D 5/54; B65D 2571/00864; B65D 2571/00123; B65D 2571/0277; B65D 2571/00259; B65D 2571/00265; B65D 2571/00271; B65D 2571/0032; B65D 2571/00327; B65D 71/08; B65D 71/10; B65D 71/12; B65D 71/34; B65D 71/36; B65D 71/40; B65D 71/42
USPC ..... 53/397, 398, 445, 461, 462, 48.1–48.9, 53/202, 448, 543
See application file for complete search history.

(56) References Cited

U.S. PATENT DOCUMENTS

| | | | | |
|---|---|---|---|---|
| 3,078,988 A | | 2/1963 | Dunning | |
| 3,277,628 A | * | 10/1966 | Harrison | 53/442 |
| 3,488,913 A | * | 1/1970 | Burgess | 53/442 |
| 3,545,165 A | * | 12/1970 | Greenwell | 53/398 |
| 4,424,658 A | * | 1/1984 | Focke | 53/398 |

(Continued)

FOREIGN PATENT DOCUMENTS

| | | |
|---|---|---|
| WO | WO-2006135538 A1 | 12/2006 |
| WO | WO-2008013872 A2 | 1/2008 |

*Primary Examiner* — Stephen F Gerrity
*Assistant Examiner* — Joshua Kotis
(74) *Attorney, Agent, or Firm* — Dicke, Billig & Czaja, PLLC

(57) ABSTRACT

An article processing method is generally provided, namely, a method in furtherance of the formation of a split or splittable article pack. Spaced apart article groups are formed from a stream of articles. Each panel of panels of a supply of panels is passed through a processing station for execution of a processing step so as to establish a stream of processed panels. A processed panel of the stream of processed panels is associated with an article group of the spaced apart article groups so as to form a splittable article pack. The splittable article pack may be bundled for subsequent splitting, or split via in-line processing and discrete sub-packs having origins in the split splittable article pack bundled.

14 Claims, 20 Drawing Sheets

(56) References Cited

U.S. PATENT DOCUMENTS

| | | | | | |
|---|---|---|---|---|---|
| 4,730,437 | A | * | 3/1988 | Benno | 53/399 |
| 4,793,117 | A | * | 12/1988 | Raudat et al. | 53/48.1 |
| 5,148,654 | A | * | 9/1992 | Kisters | 53/462 |
| 5,249,738 | A | * | 10/1993 | Werth | 229/235 |
| 5,299,733 | A | | 4/1994 | Werth | |
| 5,419,431 | A | * | 5/1995 | Neuber et al. | 206/256 |
| 5,579,911 | A | | 12/1996 | Werth | |
| 5,645,163 | A | | 7/1997 | Werth | |
| 5,727,367 | A | * | 3/1998 | Cahill et al. | 53/462 |
| 5,765,336 | A | * | 6/1998 | Neagle et al. | 53/201 |
| 5,857,570 | A | * | 1/1999 | Brown | 206/427 |
| 5,887,717 | A | | 3/1999 | Anderson et al. | |
| 6,027,017 | A | | 2/2000 | Kuhn et al. | |
| 6,182,422 | B1 | | 2/2001 | Andersen et al. | |
| 6,499,596 | B1 | | 12/2002 | Andersen et al. | |
| 6,588,594 | B2 | * | 7/2003 | Andersen et al. | 206/497 |
| 6,874,633 | B2 | | 4/2005 | Andersen et al. | |
| 6,978,892 | B2 | | 12/2005 | Bansal et al. | |
| 7,048,817 | B1 | * | 5/2006 | Hammond | 156/64 |
| 7,322,171 | B2 | * | 1/2008 | Bonnain et al. | 53/446 |
| 7,328,550 | B2 | | 2/2008 | Floding et al. | |
| 7,370,761 | B2 | | 5/2008 | Andersen et al. | |
| 7,467,504 | B2 | | 12/2008 | Mate et al. | |
| 7,527,152 | B2 | | 5/2009 | Lentner et al. | |
| 7,604,114 | B2 | | 10/2009 | Gessler | |
| 7,845,494 | B2 | | 12/2010 | Cerveny et al. | |
| 8,033,449 | B2 | * | 10/2011 | Ho Fung et al. | 229/122.1 |
| 8,333,054 | B2 | * | 12/2012 | Hartl | 53/413 |
| 2003/0155266 | A1 | | 8/2003 | Andersen et al. | |
| 2003/0159407 | A1 | * | 8/2003 | Hendriks van de Weem et al. | 53/452 |
| 2005/0139502 | A1 | * | 6/2005 | Andersen et al. | 206/427 |
| 2006/0278691 | A1 | | 12/2006 | Bezek | |
| 2008/0179320 | A1 | | 7/2008 | Abel et al. | |
| 2011/0083986 | A1 | | 4/2011 | Zimmermann et al. | |

* cited by examiner 32
32a
52
42
52
52
52

SPLIT/SPLITTABLE RETAIL READY PACKAGE

This is a United States national patent application filed pursuant to 35 USC §111(a) claiming priority under 35 USC §120 of/to U.S. Pat. Appl. Ser. No. 61/515,403 filed Aug. 5, 2011 and entitled SPLIT/SPLITTABLE RETAIL READY PACKAGE, the disclosure of which is hereby incorporated by reference in its entirety.

TECHNICAL FIELD

The present invention generally relates to retail ready packages, more particularly, to the formation or production of split or splittable retail or "shelf-ready" packages (e.g., article packs), or packages per se, the packaging lines and tray blanks formable into trays part-and-parcel of a split or splittable shelf-ready package, and processes and attendant work stations associated with such production.

BACKGROUND OF THE INVENTION

There continues to be increasing pressure to maintain and preferably increase profits for consumer goods and the like. With the advent and expansion of "super stores," and continuing vitality and efforts of merchandise clubs and the like, further supply side pressures exist.

It remains advantageous to minimize merchandise handling, i.e., resource reliance in getting merchandise from a producer to a store shelf. Retail or shelf-ready packages, e.g., article packs, are believed supremely advantageous as there exist minimal, if any, preparation in transition from shipping to retail display. Moreover, there exists increasing competition for merchandise shelf space, and greater emphasis in connection to the merchandise display hierarchy. Further still, an increasing trend to down size display packages has created challenges for combined shipping-display packages with regard to palletization, namely, maintaining the integrity of the palletized product in distribution. Thus, there generally exists an ongoing tension between merchandise transport/supply needs on the one hand, and merchandise display needs on the other hand.

Efforts to date have yielded a variety of article packs, e.g., container package or case assemblies. Generally well known are container package assemblies characterized by either a traditional carton enclosures to provide a bundling for or containment of grouped articles, or those characterized by film wrapping to provide the bundling for or containment of grouped articles.

As to the former, such carton approach appears commonly practiced in connection to, for example, cylindrical articles such as cans. Paper/card board holders or wrapper forming blanks are and have been well know for such purposes, with adaptations provided in furtherance of splitting, subdividing or accessing the package contents provided.

For example, Dunning (U.S. Pat. No. 3,078,988) discloses a paper board holder formed of a blank characterized by a transverse weakened line of separation. In as much as a single package of six articles may be displayed (FIG. 1 or FIG. 6), a bifurcation of the holder about the transverse weakened line of separation permits the display and offering of two subunits of the packaged articles.

Moreover, as is well known with regard to beverage cans and the like, a twenty-four article pack case, for example, may be adapted to be readily divisible or "splittable" into two twelve article packs and those in turn "splittable" into two six article packs (see e.g., the teachings of Werth (U.S. Pat. Nos. 5,249,738, 5,299,733, 5,579,911, & 5,645,163), and/or the carton may be adapted such that the contents thereof are easily accessed by a consumer (see e.g., Brown (U.S. Pat. No. 5,857,570)).

Likewise, a variety of lidded article packs or packages, characterized by one or more discrete or individual trays, are known in the context of traditional carton enclosures for containing grouped and/or bundled articles, for instance, those exemplified by the teachings of Zimmermann et al. (U.S. Publ. No. US 2011/0083986), Nueber et al. (U.S. Pat. No. 5,419,431), and Kuhn et al. (U.S. Pat. No. 6,027,017) wherein a lid, cover, hood, etc., for cooperative engagement with a tray or article base, is readily removed from the article pack or package assembly, or modified, in furtherance of in-store display of the trayed articles or the separate article trays of the multi-bundle pack. Finally, boxed article packs, such as trayed article groups, are also known, see e.g., Anderson et al. (U.S. Pub. No. 2005/0139502 A1, FIGS. 14-17), as are more traditional crate style structures which are suitable for shipping as well as product display, see e.g., Gessler (U.S. Pat. No. 7,604,114 B2).

As to the latter, film wrapping approaches appear widely practiced, with grouped articles, alone or in combination with a base (e.g., a panel such as a pad, tray blank/tray, etc.) so as to form an article pack, with a film wrapper thereabout the combination shrunken to thus define a bundled article pack or package. While single bundle packages or packs are known, see e.g., Bansal et al. (U.S. Pat. No. 6,978,892 B2), attention is directed to heretofore known multi-bundle article packs or packages.

For instance, Anderson et al., i.e., one or more of U.S. Pat. Nos. 5,887,717, 6,182,422, 6,499,596, 6,588,594, 6,874,633, & 7,370,761 B2, and U.S. Pub. Nos. 2003/0155266 A1 & 2005/0139502 A1, generally disclose film wrapped container package assemblies characterized by containers arranged upon a pair of discrete trays and overlain with a top panel, e.g., a pad. A variety of tray styles are disclosed, namely, those including zero to four sidewalls, e.g., three walled/sided tray, a four-sided tray which permits proper viewing/access to container, and a tray with no sidewalls, i.e., a pad. Moreover, a variety of side-by-side tray arrangements are shown for the multi-bundle film wrapped packs, as are head-to-head, back-to-back, and front-to-back relationships for and between the discrete trays of the film wrapped container package. While the adjacently paired trays are generally held in abutting engagement via the film wrapper, it is likewise known to reversibly unite the adjacently paired trays, via adhesive or the like, in advance of film wrapping. In any event, upon film wrapper removal, each tray of the adjacently paired trays is readily and individually handled for store/shelf display.

Continuing in the context of film wrapped article packs or packages, and generally departing from previously described separate or discrete bundles of the multi-bundle pack, reference is made to Cerveny et al. (U.S. Pat. No. 7,845,494 B2). A film enclosure or package for gathering bottles of first and second bottle groupings is generally provided. A base panel having first and second portions delimited by a folding line is provided for the receipt of the first and second bottle groupings, with a carrying handle further included and disposed vertically along the fold line thereof. Via a transversal precut in the film wrapper, pivoting of the base portions about the fold line permits access to the handle (FIG. 5) so as to form a handled bundle, i.e., twin pack, (FIG. 6) for improved handling.

While numerous container package assemblies have been noted, including split or splittable shelf-ready packages, attention is next briefly directed to packaging processes/systems for such packages, e.g., to tray packing-shrink wrapping packaging machines. Characteristic of such machines or processing lines are an infeed section or station, a metering or collation section, a tray forming and loading section, an optional stacking section, a film wrapping section and a wrap shrinking section. Further functional particulars are summarized by Neagle et al. (U.S. Pat. No. 5,765,336), incorporated herein in its entirety by reference.

In connection to processing, no doubt numerous improvements have been made. Considerable attention has been and continues to be directed to making packing processes/machines more flexible and adjustable to accommodate different size articles and different size batches (i.e., a collated group or grouping of articles), while nonetheless limiting downtime for line adaptation/part change-out, and improving, or at least maintaining, overall throughput (i.e., the number of processed articles as a function of run time).

Presumably, productivity increases may be realized via a change in operation from a single line process to a dual line process (see e.g., Neagle et al., FIGS. 1 & 2). Notionally, articles are processed in two parallel lanes to form two distinct final packages, i.e., one "dual" lane machine is intended to function as two single lane machines). Generally, having been selectively collated, an article batch is divided in-line to produce two sub-batches which proceed for simultaneous processing through tray forming and loading operations etc. In as much as Neagle et al. contemplate provisions for a tandem blank from a magazine of tandem blanks, the tandem blank is split (FIG. 6) in advance of tray forming and loading (FIG. 3) wherein parallel processing of the previously bifurcated spaced apart batch collated products commences in furtherance of outputting single packages (i.e., packages comprising single bundles or collated groups).

In as much as dual infeed systems are known and may be commercially available, shortcomings are noted. For example, complications oftentimes quickly arise in connection to simultaneous processing/synchronous operations which quickly break down and thus result in substandard article pack formation. Moreover, in the context of versatile multi-function/purpose lines for increased throughput, the downtime associated with line conversion/adaptation remains an issue.

Thus, in light of the foregoing, it is believed that improvements remain warranted in the context of a cost effective, versatile low bulk article pack or package which is capable of handling a plurality of articles and which may be readily transitioned into a shelf-ready package or packages without much fanfare. In addition to providing a substantial consumer view of the merchandise and relatively free access thereto and therefrom, the article pack or packs should include sufficient area or areas to carry and/or display product related indicia inuring to the benefit of all parties to the transaction, i.e., consumers, merchandisers, distributors, manufacturers, etc., more particularly, an area or areas which are readily provided with one or more data or information fields during the package production and/or formation process remains advantageous. Further still, with regard to the production of such package assemblies, minimizing processing downtime for line adaptations, and increasing overall article throughput for such lines in connection to the processing of articles into one or more collated batches which in turn may be bundled as circumstances warrant continue to be not insubstantial considerations with regard to advancement of the art.

SUMMARY OF THE INVENTION

Broadly and generally, one or more novel article processing methods, systems (or apparatuses, assemblies, subassemblies, mechanisms, etc.) and/or work pieces related to the formation or establishment of a split or splittable article pack are provided. More particularly, operations associated with the formation of a splittable article pack for quick, clean and ready splitting at a retail location, and such article pack, or split article packs having origins in a splittable article pack, more particularly, in-line splittable article packs, or such article pack, is generally provided.

An article processing method is generally provided, namely, a method in furtherance of formation of a split or splittable article pack. Spaced apart article groups are formed from a stream of articles. Each panel of panels of a supply of panels is passed through a processing station for execution of a processing step so as to establish a stream of processed panels. A processed panel of the stream of processed panels is associated with an article group of the spaced apart article groups so as to form a splittable article pack. Without limitation, contemplated processing for panels, namely article pack panels, includes either or both of encoding and/or forming a line-of-weakness with respect thereto. In as much as the article pack panels may comprise a pad, advantageously, tandem tray blanks are contemplated. Notionally, a single article group is associated with a processed article pack panel so as form a splittable article pack which may be split in-line so as to form first and second article sub-packs, and thereafter separately bundled, or, the splittable article pack may be bundled for subsequent splitting.

With regard to a system for forming a split or splittable article pack, it is advantageously characterized by an article pack panel infeed assembly, an article metering assembly, and a splittable article pack former. The article pack panel infeed assembly is characterized by a panel encoding station and a panel perfing station for encoding and perfing article pack panels in advance of an association of article pack panels with arrayed article groups. The article metering assembly forms arrayed article groups from a flow of articles inflowing to the article metering assembly. The splittable article pack former is characterized by mechanisms for synchronously associating an encoded and perfed article pack panel with an arrayed article group so as to form a splittable article pack.

Finally, a tandem tray blank for association with an article group in furtherance of forming a splittable article pack characterized by trayed articles is provided. More particularly, a tandem tray blank for receipt of a selectively arrayed and patterned article group characterized by a number of rows R and a number of columns C during in-line processing of streaming articles is provided. The tandem tray blank, subsequent to association with the selectively arrayed and patterned article group, is formable during in-line processing into a split or splittable pair of trays wherein each tray of the pair of trays is characterized by R/2 article rows. The tandem tray blank is characterized by a major panel and peripheral portions extending therefrom. The major panel generally includes opposingly paired sides and opposingly paired ends. Sides of the opposingly paired sides and ends of the opposingly paired ends delimit an area from which tray bases are formable. The peripheral portions extend from at least one side of the opposingly paired sides and from at least one end of the opposingly paired ends. The peripheral portion or portions extending from the at least one end of the opposingly paired ends is coextensive with an end from which it extends. The peripheral portion or portions extending from the at least one side of the opposingly paired ends have opposingly lateral flap forming end portions, flaps of said flap forming end portions selectively engageable with adjacent peripheral portions so as to delimit upstanding wall portions for a tandem tray formed from the tandem tray blank. More specific features and advantages obtained in view of those features will become apparent with reference to the drawing figures and DETAILED DESCRIPTION OF THE INVENTION.

DETAILED DESCRIPTION OF THE INVENTION

As a threshold matter, the subject teaching, in the context of forming and bundling split or splittable article packs, is broadly directed to the passage of panels, most commonly but not necessarily article group pads or tray blanks, from a supply of panels through a processing station for the execution of one or more preliminary processing steps. In furtherance of a subsequent description of particulars with regard to initial or preliminary processing and details in connection to subsequent advantageous processing of such panels and advantageous article pack operations, several preliminary disclosure related observations are to be noted.

Figure 1:
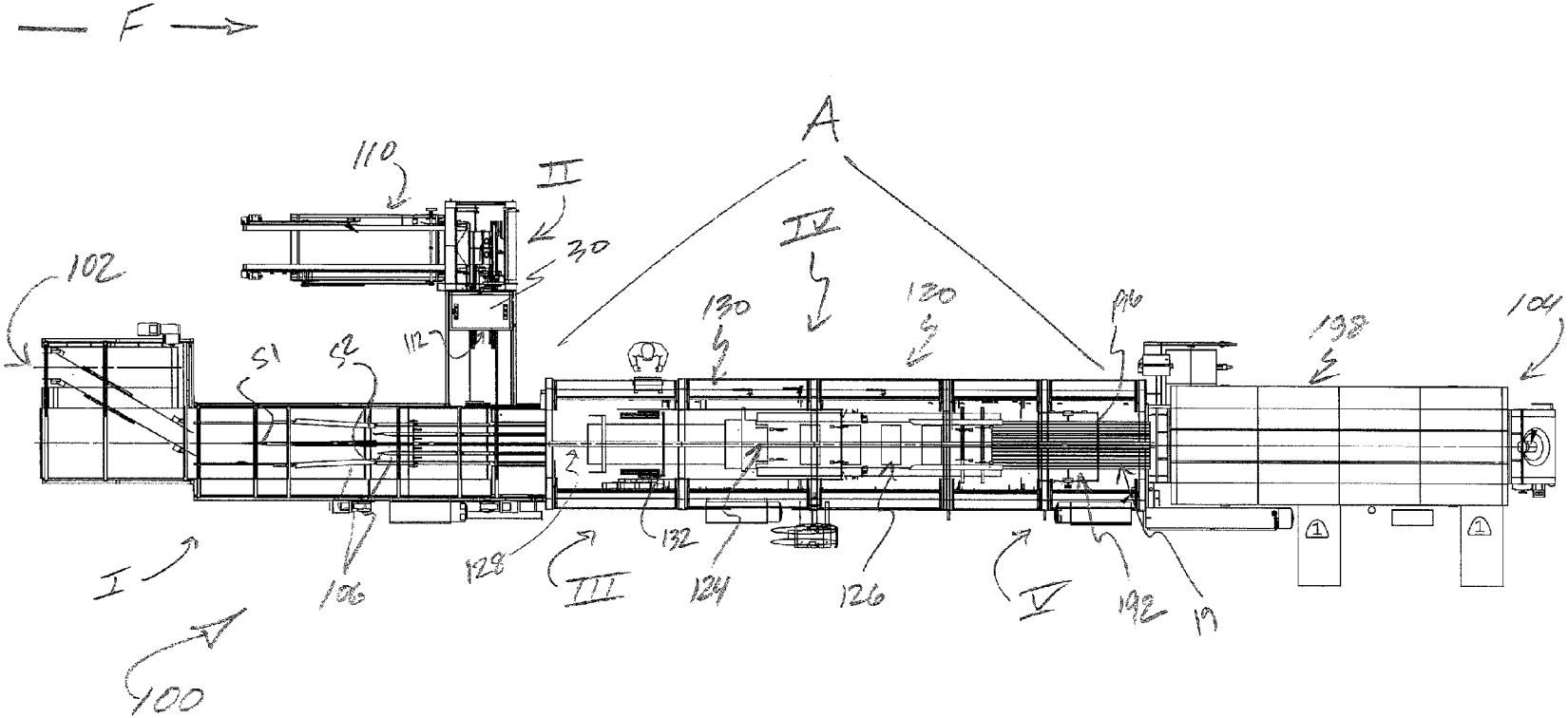
FIG. 1 depicts, in plan view and process flow left to right, an illustrative processing line for processing articles, more particularly, for forming and bundling split or splittable article packs, namely, a processing line generally characterized by an article infeed station or section (I), an article pack panel magazine and transfer station (II), an article metering section (III), an optional article pack splitting and tray forming section (IV), and an article pack bundling station (V) generally and advantageously characterized by a wrapping station, and a wrap shrinking apparatus.

First, an illustrative, advantageous, non-limiting article processing line is generally depicted, FIG. 1, plan view. More particularly, and as will be subsequently presented, the as depicted processing line is fairly characterized by a number of sections or stations, each possessing one or more select functionalities in connection to article processing, namely, in furtherance of forming a split and bundled article pack. It will become apparent as this description proceeds, that modifications to the depicted processing line are contemplated, as for example, in furtherance of forming a splittable article pack/splittable bundled article pack in contradistinction to in-line formation of a split article pack/split bundled article pack. For instance, and without limitation, provisions are made for: an article infeed (I); a supply and transfer of article pack panels (II); article metering (III); optional article pack splitting and tray forming (IV); and, a split or splittable article pack bundling station (V).

Figure 2:
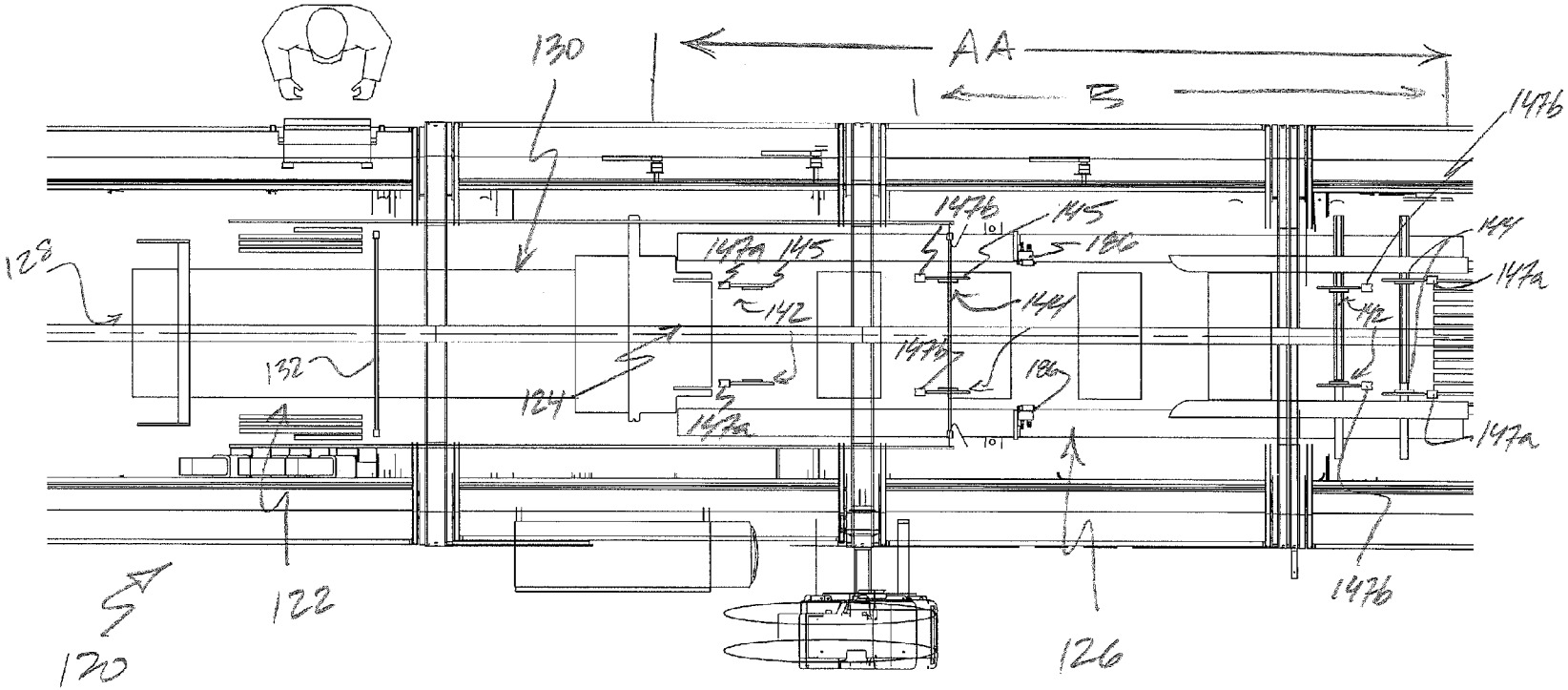
FIG. 2 depicts, enlarged view, portion "A" of the processing line of FIG. 1.
Figure 3:
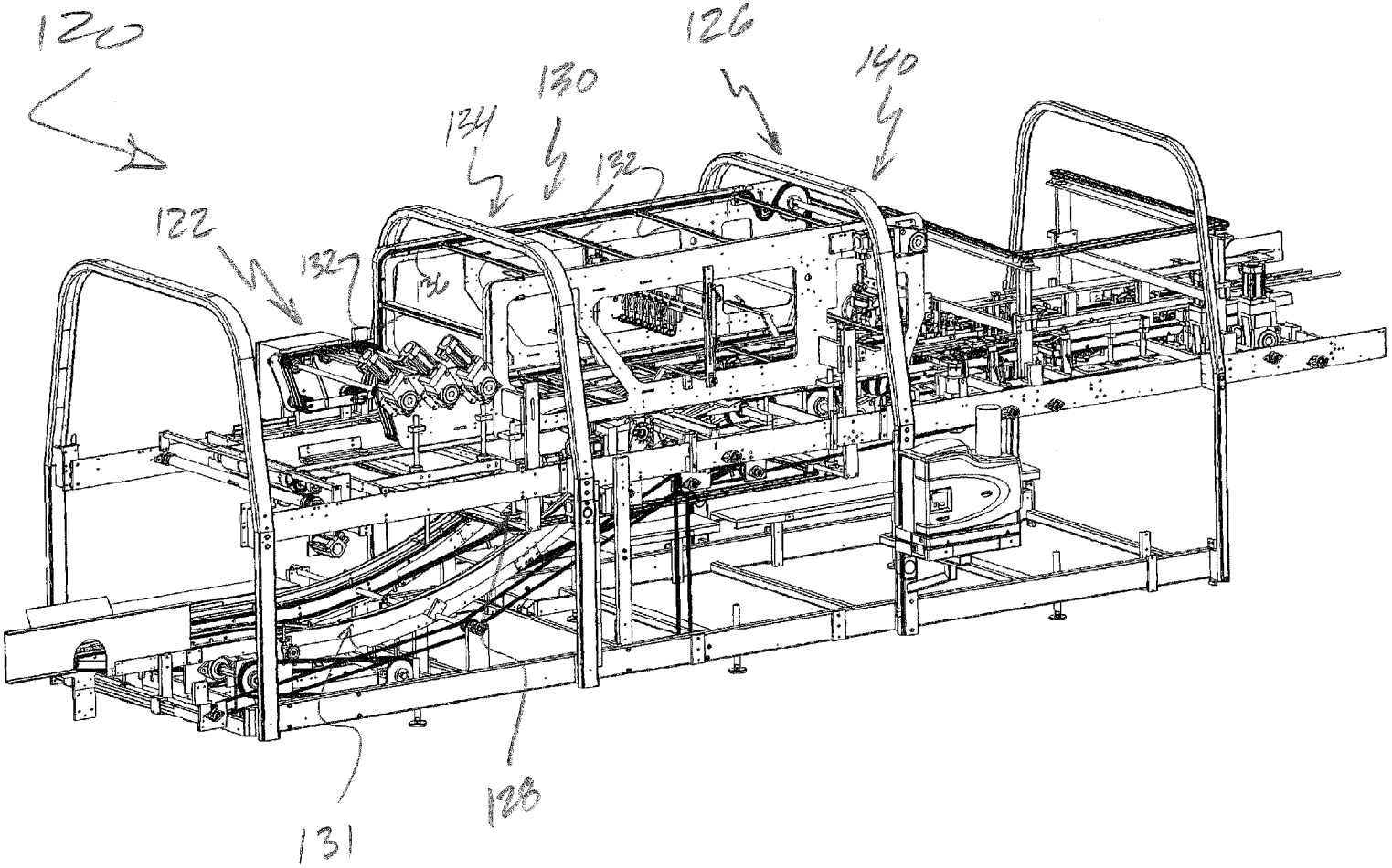
FIG. 3 depicts, perspective view slightly from above and process flow left to right, a system of the processing line portion of FIG. 2.
Figure 4:
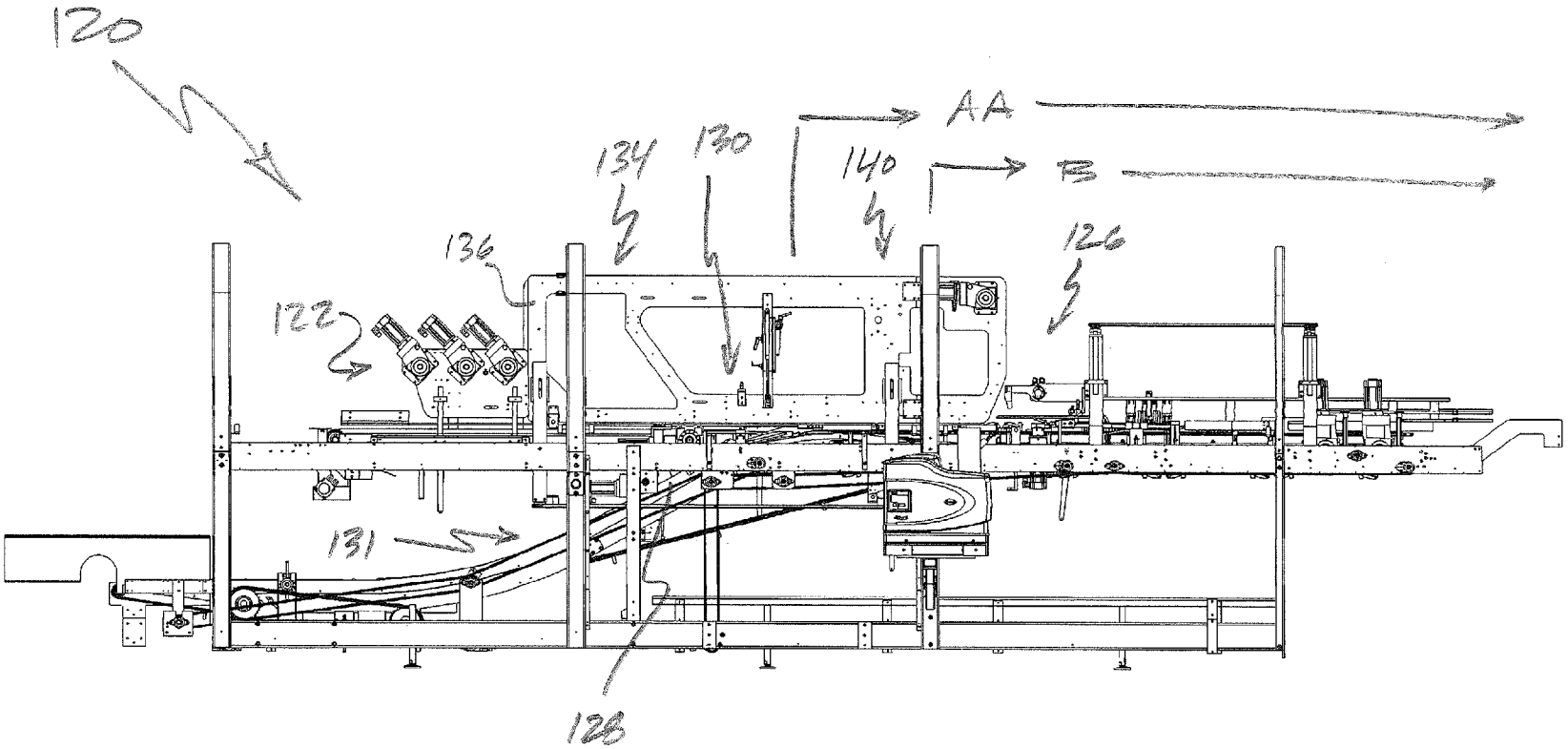
FIG. 4 depicts, side elevation, the system of FIG. 3.

Second, portion "A" of the article processing line of FIG. 1, namely, an advantageous, non-limiting system as per the views of FIGS. 2-4, is a primary but not exclusive focal point for discussion in relation to, among other things, at least in-line article pack splitting, and more comprehensively as shown, article pack splitting and tray forming. Particulars of the depicted system are subsequently developed in connection to the views of FIGS. 5-7 wherein a preferable, non-limiting assembly is depicted in connection to a splitting operation for or upon splittable article packs. Further contemplated advantageous assemblies and/or mechanism to effectuate splitting of splittable article packs are likewise depicted in FIGS. 8-13, more particularly, in each of FIGS. 8, 10 & 11 thereof.

Figure 18:
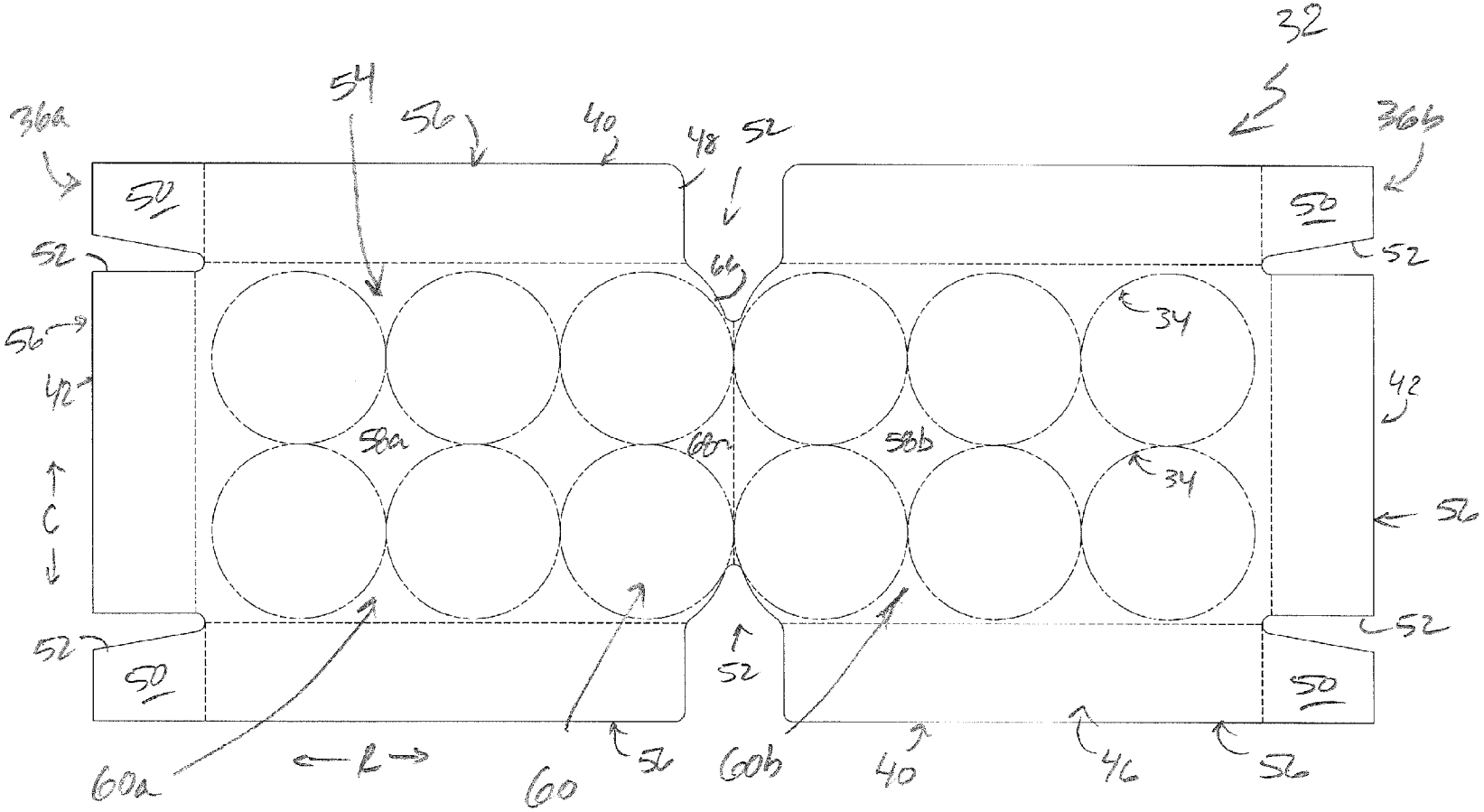
FIG. 18 depicts, plan view, a fifth advantageous tandem tray blank, namely, a tandem tray blank for combination with a 6×2 article group array, more particularly, a head-to-head splittable tandem blank formable into two three-sided article group trays, i.e., trays characterized by an open end.
Figure 19:
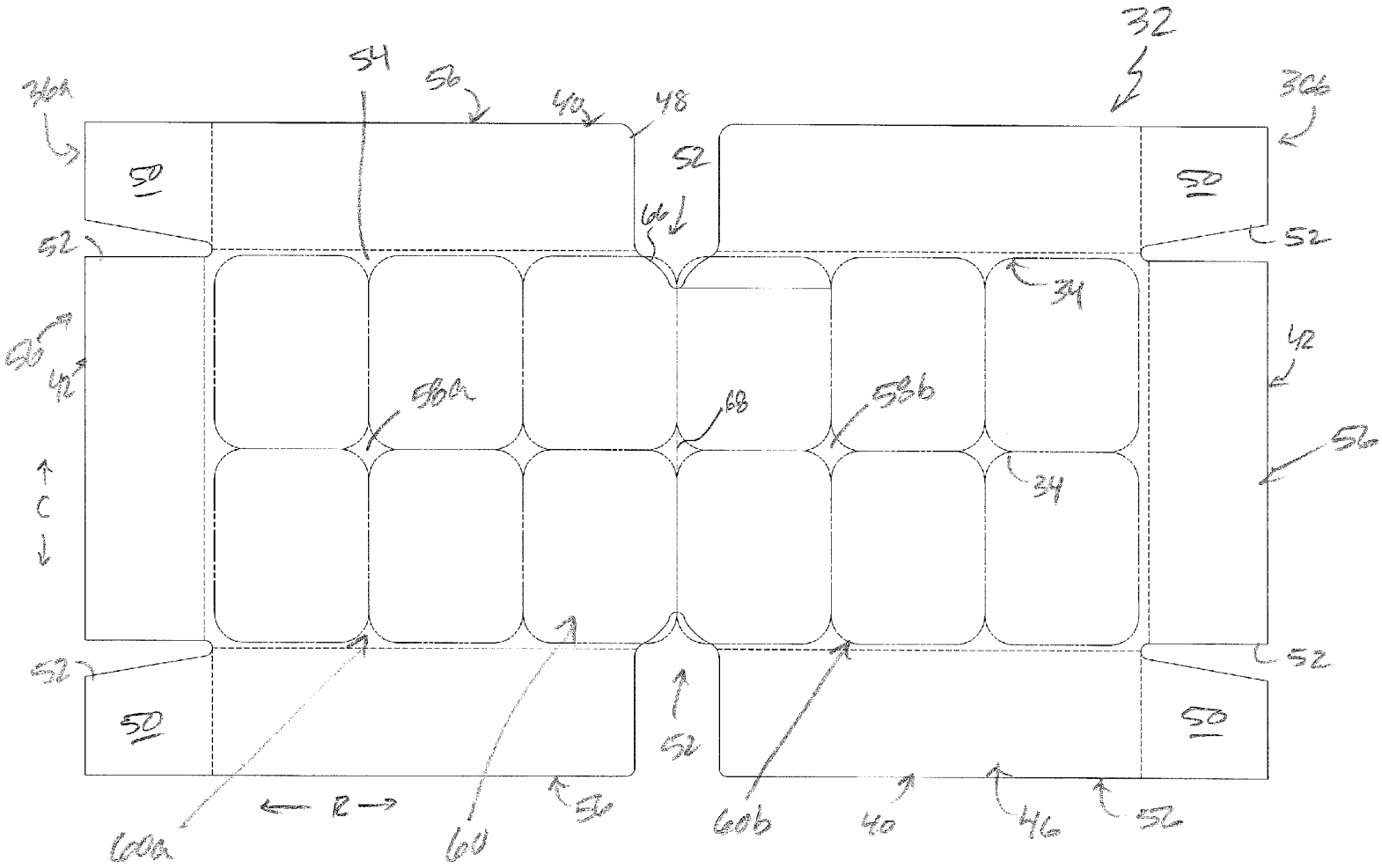
FIG. 19 depicts, plan view, a sixth advantageous tandem tray blank, namely, a tandem tray blank for combination with a 6×2 article group array, more particularly, a head-to-head splittable tandem blank formable into two three-sided article group trays, i.e., trays characterized by an open end; and, FIG. 20 depicts, plan view, a seventh advantageous tandem tray blank, namely, a tandem tray blank for combination with a 6×2 article group array, more particularly, a head-to-tail splittable tandem blank formable into two three-sided article group trays, i.e., trays characterized by an open end.
Figure 20:
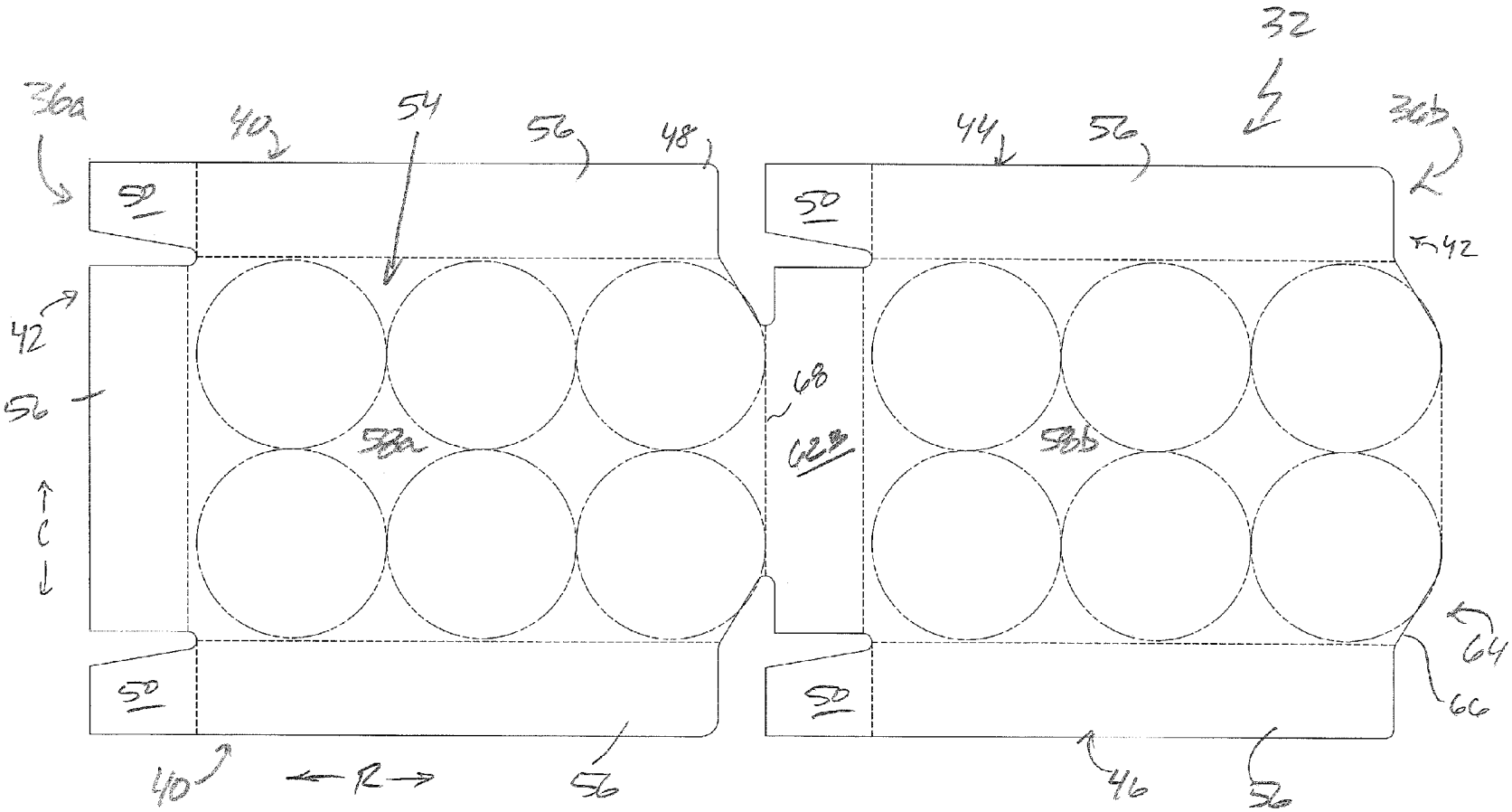

Third, and finally, a variety of advantageous, non-limiting tandem tray blanks are depicted in FIGS. 14-20. More particularly, FIGS. 14 & 15 each depict contemplated side-by-side tandem tray blanks for combination with a 4×3 article group or grouping, splittable so as to delimit a discrete pair of 2×3 article packs. Owing to the configuration of the tandem blank, the character of the tray to be formed, and the preferred orientation for presentation in relation to grouped articles, in-line splitting is a requisite to complete tray formation, more particularly, owing to tray sidewalls sharing a common boundary as will later be explained. Contemplated head-to-head tandem tray blanks for combination with adjacent 6×2 article group or grouping are depicted in FIGS. 16-19, splittable so as to delimit a discrete pair of 3×2 article packs, and a contemplated head-to-tail tandem tray blank for combination with adjacent 6×2 article group or groupings, likewise splittable so as to delimit a discrete pair of 3×2 article packs is depicted in FIG. 20.

With reference now to FIG. 1 wherein there is shown an article processing line 100, articles from a supply of articles are generally operated upon between a processing line ingress segment or portion 102 and processing line egress segment or portion 104. The ingress portion is generally characterized by discrete articles (not shown), commonly but not necessarily containers such as, and without limitation, cans, bottles, jars, cups, etc., with the egress portion generally characterized by bundled article packs (not shown). Notionally, and advantageously, split or splittable article packs are formed, namely, split or splittable article packs comprised of a combination of selectively arrayed or patterned articles and an article pack panel, e.g., a pad, a tray, etc.

Intermediate operations attendant to or associated with article infeed section I and article pack bundling section V are operations attendant to or associated with article pack panels, article metering/pack pattern establishment, and split or splittable article pack formation. Initially, and as is generally well known, articles from a supply of articles are conveyed in flow direction F (FIG. 1, left to right), with flow splitting of the articles occurring via infeed lanes 106 or the like in furtherance of flow management and article metering, for instance, an initial splitting S1 from one to two article "rows," and thereafter a further splitting S2 of each previously split article row so as to establish four article infeed lanes or article rows as depicted. Via well known and emerging article metering approaches, the article rows, flowing in parallel, are thereafter essentially selectively segmented so as to delimit an article array or pack pattern characterized by rows "R" and columns "C", see e.g., FIGS. 14-20, the number of article pack rows corresponding to the number of article infeed lanes or the like, and the number of pack columns corresponding to the number of articles in the segment obtained via select metering. While, greater than a single article row is required in connection to the general present objective of in-line formation of an article pack split or splittable between adjacent article "rows," advantageously, formation of an even number of rows, most commonly four or six, is contemplated, however, upward departures may be desirable, with alternatives to the outlined approach generally commensurate with processing pack objectives and/or the character of the articles being processed.

As per the processing line of FIG. 1, a supply of article pack panels 30 are provided in the context of article pack panel magazine 110 and transfer station II. Notionally, panels are associated with grouped, arrayed, or patterned articles, resulting from metering operations, in-line such that the panels, in the context of a formed article pack, are intended to underlie the patterned articles. The panels, which are generally planar, i.e., flat, elements, may comprise pads, and advantageously, consistent with the formation of a shelf-ready retail article pack, the article pack panels comprise tray blanks, for example, tandem tray blanks 32 (i.e., a single panel configured for manipulation so as to delimit two, or perhaps more, trays).

Referring now to FIGS. 14-20, a variety of contemplated tandem tray blanks 32, plan view, are shown, with article positions 34 generally indicated. Side-by-side, head-to-head, and head-to-tail blank configurations or arrangements are indicated in connection to FIGS. 14 & 15, FIGS. 16-19, and FIG. 20, respectively. In all representations, first and second formable trays 36*a*, 36*b* are shown in a left/right arrangement or landscape layout, with a processing direction D as per flow direction F (FIG. 1) from sheet bottom to sheet top as generally indicated (i.e., the tandem tray blanks shown flow for processing in a portrait layout). As should be readily appreciated in light of the tandem tray blanks of FIGS. 14-20, and the disclosure to this point, splitting advantageously comprises a bifurcation in the direction of travel.

Generally, the article pack panels may be fairly characterized by a length "L" and a width "W," and by sets of opposing paired sides, e.g., opposing longitudinal, i.e., long, sides 40 and opposing lateral, i.e., short, sides 42. In keeping with generally known and accepted conventions, L is dimensioned to be greater than W, and a longitudinal side of the article pack panel is dimensioned to be greater than a lateral side of the article pack pattern. In as much "leading" 44 and "trailing" 46 edge portions for the tandem tray blanks 32 correlate to or correspond with longitudinal sides thereof (i.e., the number of article rows "R" exceeds the number of articles in an article segment, article columns "C" if you will), a contrary scenario is nonetheless contemplated, and may prove advantageous. For example, in the context of the rowed articles suggested by the FIG. 14 tandem tray blank, to the extent that a splittable twenty-four-pack is contemplated, the segment length, i.e., the number of columns C, would essentially double, with a long side for such tandem blank being contrary of that heretofore described and shown, namely, the leading and trailing edges of the flowing article pack so characterized would correlate to or correspond with the short side, i.e., width or lateral edge, of the blank.

As to features of the tandem tray blanks depicted in FIG. 14-20, the blanks generally include a periphery 48 characterized by tab or flap defining relief areas 52, e.g., cutouts, notches, etc. The blanks 32 may be fairly characterized by a major panel 54 and peripheral portions 56 extending therefrom. The major panel 54 generally comprises adjacent tray bases 58*a*, 58*b*, two in number wherein the contemplated splitting is a bifurcation of a splittable article pack, first and second grouped article portions 60*a*, 60*b* of grouped articles 60 intended to reside upon the major panel 54 or designated areas 58*a*, 58*b* thereof. In non head-to-head tandem tray blank arrangements (e.g., FIGS. 14, 15, & 20), the adjacent tray bases are in a spaced apart condition owing to the presence or inclusion of conjoined splittable/divisible upstanding wall forming members 62 (FIG. 14 or 15), one 62*a*, 62*b* for each of the trays 36*a*, 36*b* to be formed in relation to the tray bases 58*a*, 58*b*, or owing to the presence or inclusion of one upstanding wall forming member 62*b* for one of the trays 36*b* to be formed from the tray blank 32 (FIG. 20). In tandem tray configurations wherein less than four upstanding walls are contemplated, a tray edge without a peripheral portion extending therefrom, i.e., a free tray edge 64, may include an article conforming periphery 66 so as to facilitate individual article egress from such tray/bundled article pack (compare e.g., FIG. 15 with FIG. 14).

Figure 16:
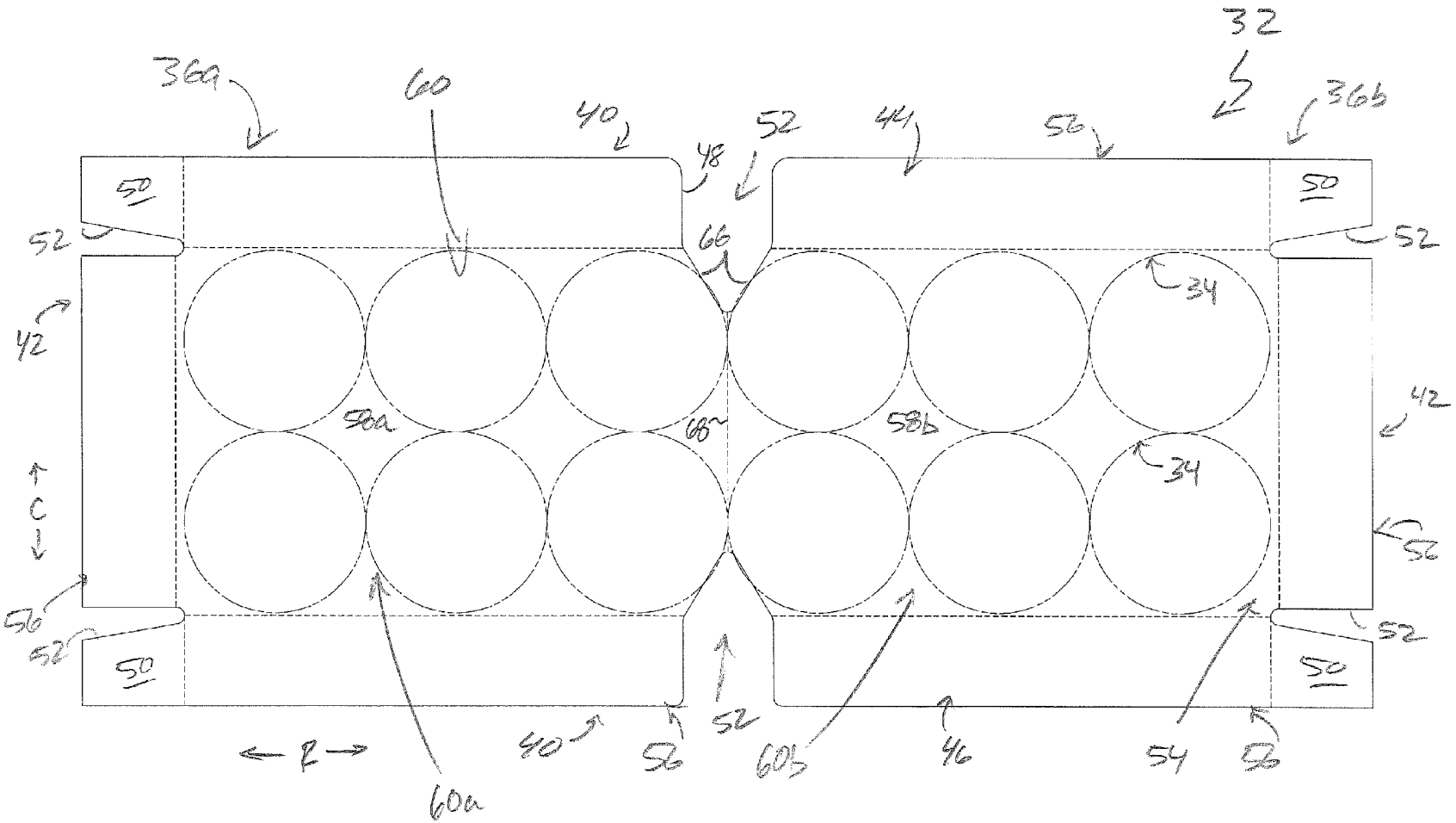
FIG. 16 depicts, plan view, a third advantageous tandem tray blank, namely, a tandem tray blank for combination with a 6×2 article group array, more particularly, a head-to-head splittable tandem blank formable into two three-sided article group trays, i.e., trays characterized by an open end.
Figure 17:
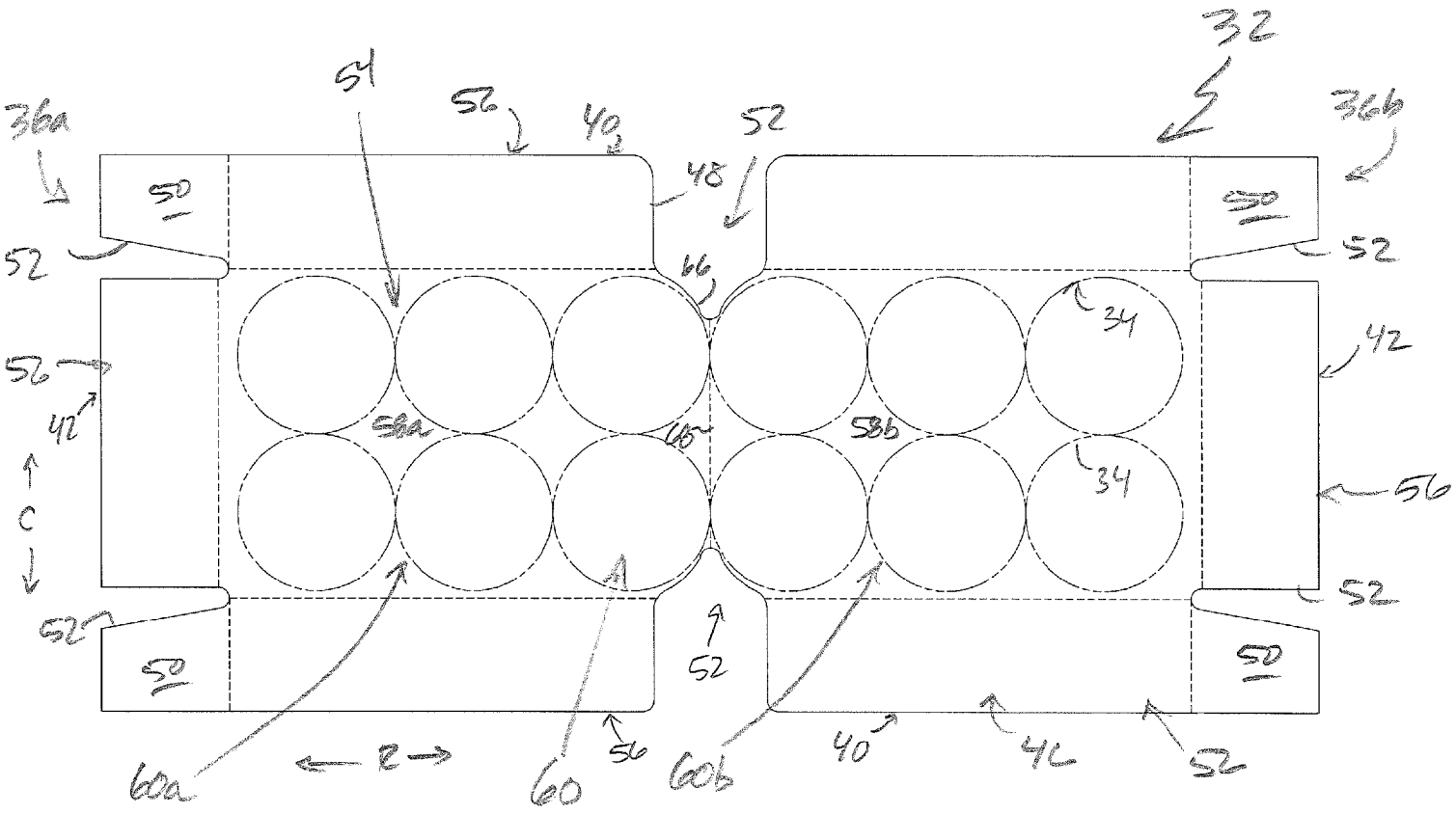
FIG. 17 depicts, plan view, a fourth advantageous tandem tray blank, namely, a tandem trat blank for combination with a 6×2 article group array, more particularly, a head-to-head splittable tandem blank formable into two three-sided article group trays, i.e., trays characterized by an open end.

With regard to peripheral portions of the exemplary tandem tray blanks illustrated, at least three such portions are generally noted, the number of portions generally predicated upon the number of upstanding walls for the tray, and their association with the major panel a function of article pack processing objectives. For example, and with reference to the tray blanks of FIGS. 14-19, a first peripheral panel extends from what is a trailing edge of the major panel with second and third panels extending in opposition from opposite sides of the major panel. As depicted, and previously referenced, relief areas in the form of cutouts, notches, etc. separate the second and third peripheral panels from the first peripheral panel in furtherance panel manipulations and tray side/end wall formation, i.e., upstanding wall formation. Moreover, a relief area is likewise contemplated in connection to the first peripheral panel, e.g., in the form of an aperture (FIGS. 14 & 15), or a notched edge (FIGS. 16-18). In connection to the tray blank of FIG. 20, a head-to-tail arrangement as opposed to the prior side-by-side (FIGS. 14 & 15) or head-to-head (FIGS. 16-18) arrangements, the second and third peripheral panels extend from leading and trailing edges of the major panel respectively, with the first peripheral panel thus generally extending in a direction of article pack flow. As in the previously described arrangements, relief areas in the form of notches or the like separate the second and third peripheral panels from the first peripheral panel in furtherance panel manipulations and tray side/end wall formation, i.e., upstanding wall formation, and each of the second and third peripheral panel portions are segmented via the inclusion of relief areas as shown.

Figure 13:
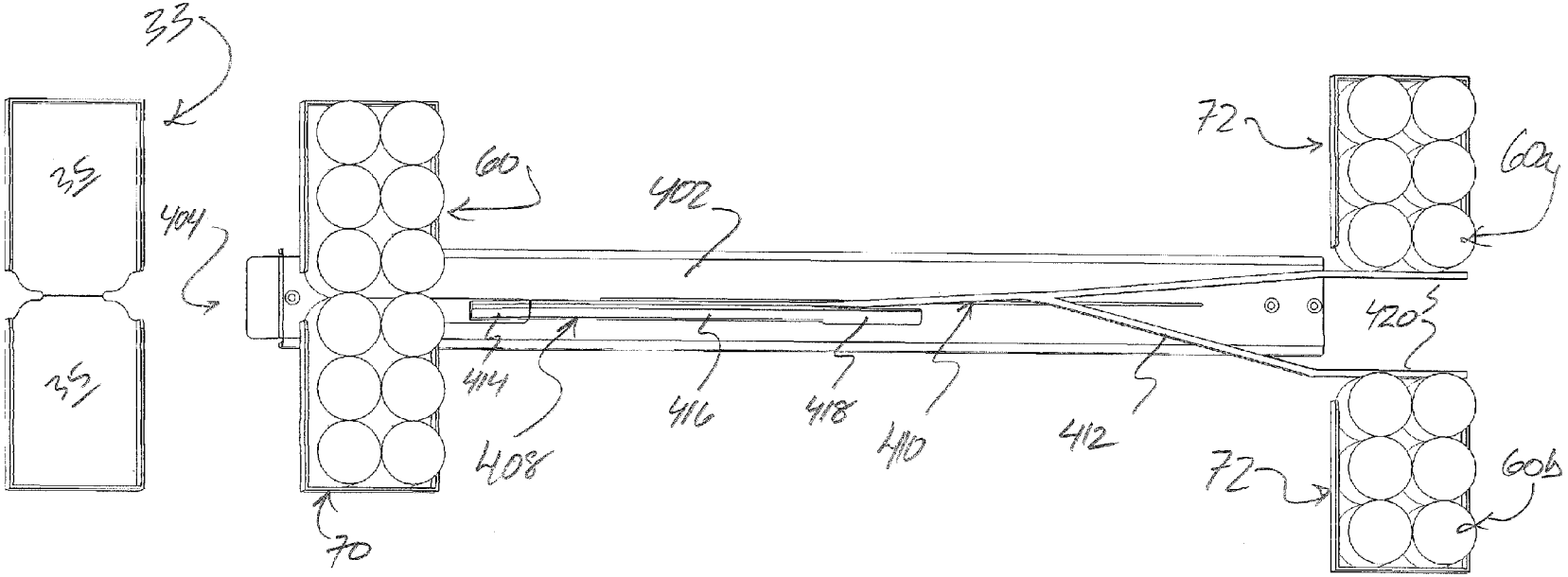
FIG. 13 depicts, plan view, the assembly and elements of FIG. 11.
Figure 14:
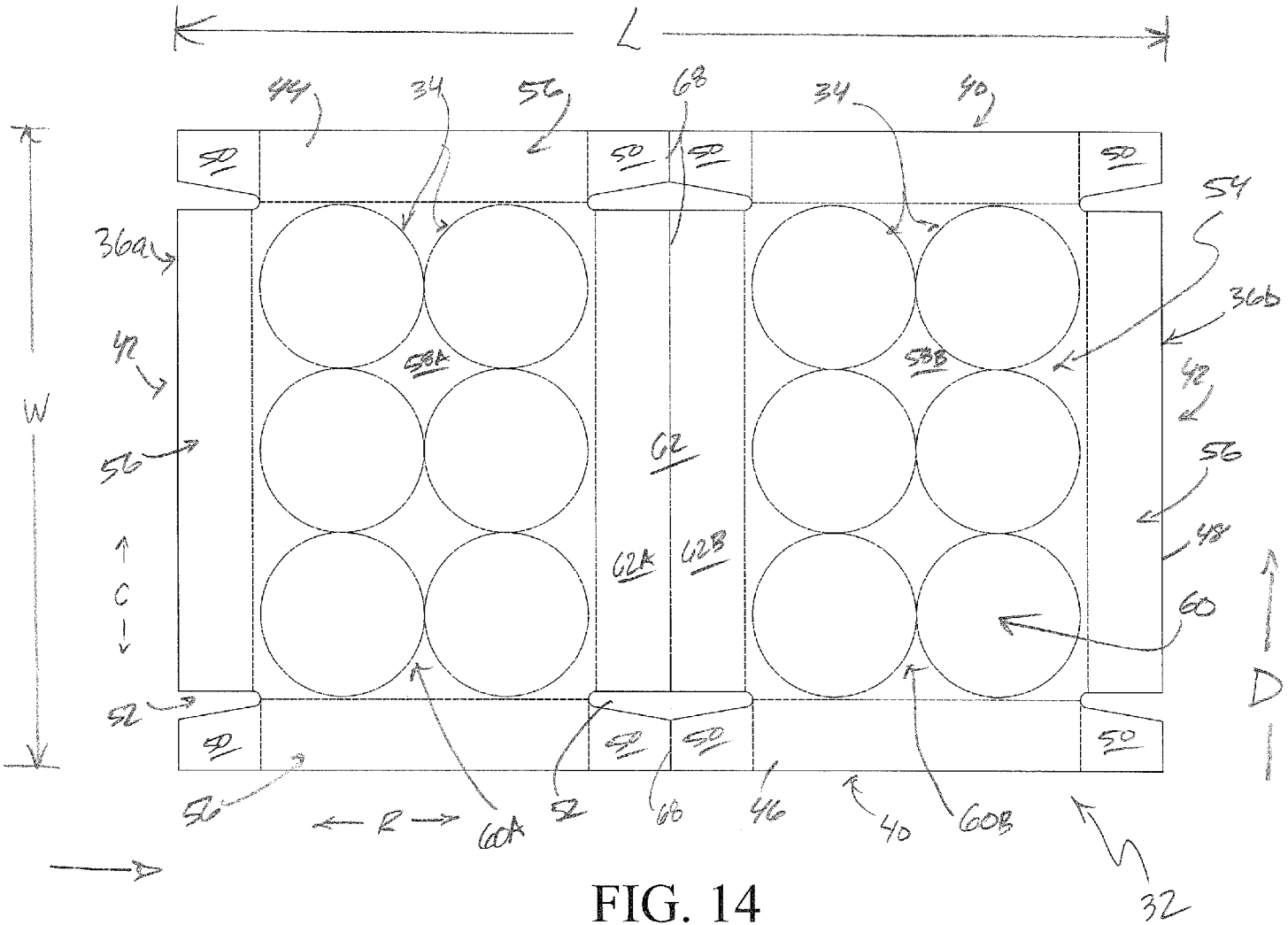
FIG. 14 depicts, plan view, a first advantageous tandem tray blank, namely, a tandem tray blank for combination with a 4×3 article group array, more particularly, a side-by-side splittable tandem blank formable into two four-sided article group trays.
Figure 15:
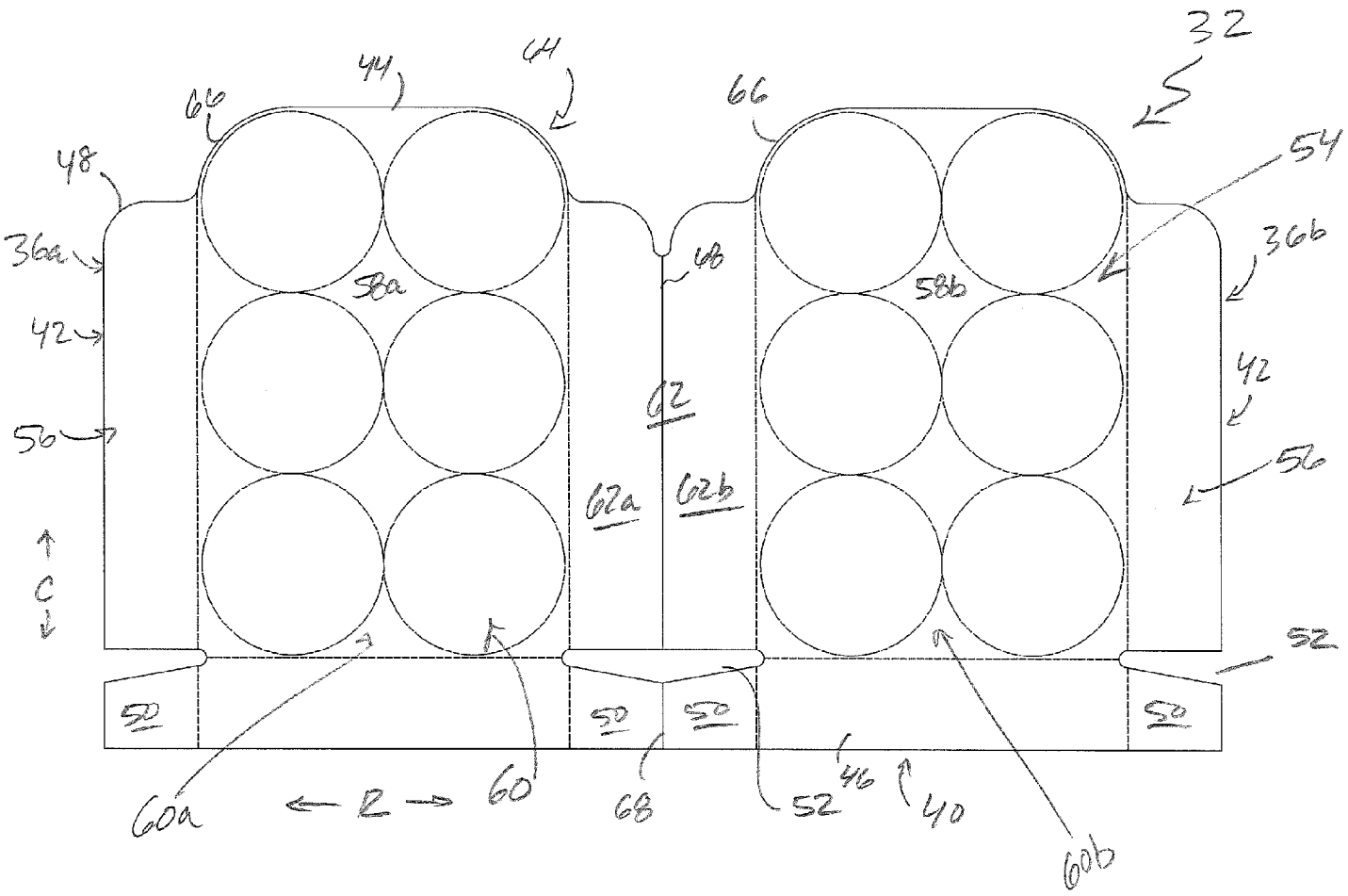
FIG. 15 depicts, plan view, a second advantageous tandem tray blank, namely, a tandem tray blank for combination with a 4×3 article group array, more particularly, a side-by-side splittable tandem blank formable into two three-sided article group trays, i.e., trays characterized by an open end.

In connection to the preferred tandem tray blanks of FIGS. 13 & 14, each contemplate receipt or other type of association with a metered article group characterized by four rows and three columns, the twelve article pack thereby so defined being split in-line in furtherance of establishing or forming two side-by-side six article packs, each characterized by two article rows and three article columns. Via in-line manipulations utilizing, e.g., lugs, tuckers, gluers, a splitter, guide rails, etc. as will later be discussed, the former tandem tray blank is formable into two four-sided trays characterized by opposingly paired first, (e.g., major or longitudinal) and second (e.g., minor or lateral) sidewalls extending from a common tray base, the latter tandem tray blank being formable into two three-sided trays, i.e., trays characterized by an "open" end, a sidewall portion of the tray blank of FIG. 13, more particularly a minor or lateral sidewall portion, and more particularly still, a "downstream" minor or lateral sidewall portion, being omitted from the instant configuration as shown. As should be appreciated in connection to conventional and emerging bundling operations characterized by film wrapping and film shrinking, bulls-eye wrapper openings result for each parallel processed bundled article pack on pack sides which extend in a direction of process flow, i.e., in the long side of article packs characterized by the trays as shown.

In connection to the alternate tandem tray blanks of FIGS. 15-18, each contemplate receipt or other type of association with a metered article group characterized by six rows and two columns, the twelve article pack thereby so defined being at least splittable in furtherance of establishing or forming two head-to-head six article packs, each characterized by three article rows and two article columns. Via in-line manipulations utilizing, e.g., lugs, tuckers, gluers, an advantageous yet optional splitter, guide rails, etc., the subject tandem tray blanks are formable into two three-sided trays characterized by opposingly paired first sidewalls, (e.g., major or longitudinal sidewalls as shown) and a further single sidewall (e.g., a minor or lateral sidewall) linking the opposingly paired sidewalls, each sidewall extending from a common tray base. As should be appreciated in connection to conventional and emerging bundling operations characterized by film wrapping and film shrinking, bulls-eye wrapper openings result on article pack sides which extend in a direction of process flow, i.e., in the short side of article packs characterized by the trays as shown, whether two adjacent six article packs emerge from processing or a single twelve article packs emerges.

In connection to the alternate tandem tray blank of FIG. 19, receipt or other type of association with a metered article group characterized by six rows and two columns is contemplated, the twelve article pack thereby so defined being splittable in furtherance of establishing or forming two head-to-tail six article packs, each characterized by three article rows and two article columns. Via in-line manipulations utilizing, e.g., lugs, tuckers, gluers, a splitter, guide rails, etc. the subject tandem tray blanks are formable into two three-sided trays characterized by opposingly paired first sidewalls, (e.g., major or longitudinal sidewalls as shown) and a further single sidewall (e.g., a minor or lateral sidewall) linking the opposingly paired sidewalls, each sidewall extending from a common tray base. As should be appreciated in connection to conventional and emerging bundling operations characterized by film wrapping and film shrinking, bulls-eye wrapper openings result for each parallel processed bundled article pack on pack sides which extend in a direction of process flow, i.e., in the short side of article packs characterized by the trays as shown.

With renewed reference to the article pack panel magazine and transfer station II, article pack panels 30 from the supply of article pack panels 110 are advantageously coded on a surface thereof during transfer operations, more particularly, in advance of association of the article pack panels with the metered article groups, arrays, or patterns. Essentially, indicia, e.g., alpha numeric or other "data" relating to the articles for packaging, is printed or otherwise applied to each article pack panel. More particularly, an article pad or tray is encoded along a "long side," in the context of an elongate tray, with indicia advantageously carried upon an exterior, visible sidewall, as opposed to an end wall, surface.

Subsequent to individual dispensing of article pack panels 30 from the article pack panel magazine 110, each article pack panel passes an article coding station 112, located generally as indicated FIG. 1. With a supply of article pack panels, in the form of a magazine or the like, in a spaced apart condition from the article flow path, metered dispensing in furtherance of grouped article association, i.e., article pack panel ingress, is generally perpendicular to the travel path of the articles as shown. Moreover, with panels dispensed and delivered in an ingress direction as shown in FIG. 14, namely, such that leading/trailing article pack edge portions extend in the direction of ingress travel, advantageous article panel coding is possible. Via the subject process configuration and article pack panel orientation, for each pass of an article pack panel 30 through the coding station 112, two sequentially passing article pack segments receive encoding, the two article pack segments generally corresponding to portions of discrete article pack panels, e.g., pads or trays.

In advance of the presentation of further particulars, a summary of salient notions and/or details to this point will better inform the balance of the disclosure. First, the formation or production of a split or splittable article pack characterized by an article group, array or pack pattern, including such article pack per se is believed advantageous and especially desirable. More particularly, individually bundled discrete article packs or bundled separately separable discrete packs of an article pack, which are shelf-ready with little fanfare, i.e., with nothing more than hand manipulation in furtherance of wrapper removal, or, as the circumstance warrants, splitting of jointly formed discrete "packs" of article packs and wrapper removal therefrom, are an elegant "solution" for merchants, and a enviable proposition for manufacturers owing to a consolidation of processing steps (e.g., a variety of "two-for-one" operations), and/or opportunities for parallel processing. Notionally, an article pack panel, generally dimensioned and/or configured to underlie an article grouping characterized by, e.g., first and second article subgroups (FIGS. 14-20), is initially operated upon at a coding station during an infeed operation so as to display at least two spaced apart long side encodings such that each separate or separable discrete article pack bears encoded indicia. Thereafter, as subsequently detailed, article pack panels, which may be further processed to facilitate article pack splitting, are associated with grouped articles, and either split for subsequent parallel processing to yield discrete article packs, or bundled directly to yield bundled article packs characterized by separable discrete article packs of a bundled article pack.

Referring now to FIGS. 2 & 3, there is generally shown, in differing views, an advantageous, non-limiting system 120 corresponding to area "A" of the process of FIG. 1, namely, one characterized by, among other things, a metering station 122, an article panel pack merge segment 124, and, in the context of side-by-side tandem tray blank processing, a splitting and tray formation station 126. It is to be noted that the splitting and tray formation station is provided in contemplation of the use of tandem tray blanks, more particularly, in contemplation of the use of tandem tray blanks which are necessarily split in advance of manipulations to complete tray forming (e.g., those of FIGS. 14, 15 & 20). Moreover, the functions of splitting and tray formation are not necessarily conjunctive functions, as splitting or tray forming, one without the other, may be necessitated as processing objectives warrant. For example, and without limitation, to the extent the article pack panel comprises a pad, tray forming steps/mechanisms would be unnecessary, and to the extent the article pack comprise a tandem tray blank as per any of those of FIG. 16-19, a splitting mechanism/step may not be necessary. The balance of the disclosure in connection to the system of FIG. 2 presumes processing of tandem tray blanks as depicted in either of FIG. 14 or 15, with functions or operations intermediate article pack formation and article pack wrapping being contingent upon, among other things, the character of the articles and the packaging objectives. In furtherance thereof, a modular or turn-key approach is provided in connection to apparatus, assemblies and/or mechanisms to effectuate advantageous functions operations intermediate article pack formation and article pack wrapping, namely, provisions for processing units which may be readily brought on/off line as circumstances warrant.

As best appreciated with regard to the view of FIG. 3, infed encoded article pack panels from article pack panel magazine and transfer station II travel below a flow or stream of articles infed from the article infeed station or section I and up and towards same so as to essentially merge with a metered flow of grouped, arrayed or patterned articles downstream. Although not shown, the article pack panel infeed to the article processing line is characterized by a mechanism to effectuate a "flipping," via an indexed 180° rotation, such that the encoded panel surface is reoriented from "upward" facing, to "downward" facing in furtherance of display of encoded indicia readily discernable without resort to article manipulation, e.g., removal of articles from the article pack. It is to be noted that the manner of association of the article pack panels to/with the grouped articles is not considered especially critical and/or limiting, however, forming an article pack characterized by an article pack panel in combination with an article group, array or pack is a requisite to the contemplated formation of a split or splittable article pack. In addition to a merged association, pick-and-place or other means of associating the grouped articles and article pack are contemplated.

Further operations upon or in connection to the article pack panel are contemplated in advance of an association with an article group. Advantageously, but not necessarily, a line-of-weakness, e.g., a perforation or the like, is imparted or otherwise formed in the article pack panels to facilitate splitting of an article pack so characterized. A panel perfing station 128 is advantageously positioned (FIGS. 1 & 2) such that panels pass therethrough in advance of or prior to discharge for merged association with the article groups. Generally, a perfing wheel or the like is operatively supported for engagement or select engagement with passing article panels such that a line-of-weakness, extending from a leading edge of the panel toward a trailing edge thereof, is formed. More particularly, in the context of the tandem tray blanks of FIGS. 14 & 15, a line-of-weakness 68 is advantageously formed across a width (W) of the blank 32, and generally intermediate a length (L) thereof, so as to facilitate splitting, whether in-line as will be later detailed, or subsequent to processing as may be the case for article packs characterized by an article pad or tray blank which does not require in-line splitting in furtherance of tray formation.

As best appreciated with reference to FIGS. 1 & 3, while article pack panels advance towards their association with grouped articles, e.g., via merger therewith as contemplated, infed articles undergo metering at metering station 122 so as to form select article groups, arrays or pack patterns. Advantageously, but not necessarily, metering approaches described and/or depicted in any of U.S. Pat. No. 6,793,064 (Schoeneck et al.), U.S. Pat. No. 6,843,360 (Peterman et al.), U.S. Pat. No. 7,222,716 (Peterman et al.), U.S. Pat. No. 7,533,768 (Floding et al.), & U.S. Pat. No. 8,011,495 (Anderson et al.), each incorporated by reference herein in their entireties, are contemplated. It is to be noted that the manner of metering the infeed articles so as to establish a flow of spaced apart article groups, arrays or pack patterns is not considered especially critical and/or limiting, however, forming a flow or stream of spaced apart article groups, arrays or pack patterns is a requisite to the contemplated formation of a split or splittable article pack.

Upon establishment of an article group or pack pattern, the article group generally advances in the direction of flow, via for example, a transfer station or the like. Operations associated with the transfer station 130 may include manipulations in advance of association of the article group with an article pack panel, for instance, advantageously and without limitation, spacing portions the article group apart from each other so as to establish a select distance or gap for and between splittable portions thereof, e.g., establishing a select spacing between first and second article subgroups (e.g., 60*a*, 60*b*) owing to the intermediate common margin (e.g., 62) present in the side-to-side tandem tray blanks of either of FIGS. 14 & 15, and the association of the article group 60 with an article pack panel so as to form an article pack 70.

As should be readily appreciated, a static flow manager or splitter (not shown), through which article groups pass, may be provided. Spaced apart sweep bars 132 or the like, of an overhead conveyance assembly or apparatus 134, travel about a defined travel path 136 for engagement with spaced apart article groups so as to aid their advancement toward and through the flow splitter or spacer for selectively spacing apart the streaming or flowing article groups. Moreover, sweep bars maintain downstream pressure on article packs, i.e., sweep bars maintain their engagement with article groups subsequent to the association of the article pack panels with the article groups in furtherance of continued advancement of the combination toward the article pack splitting and tray formation section IV.

With continued reference to FIGS. 2 & 4, more particularly, portions "AA" thereof, there is generally depicted an advantageous assembly 140 for initial handling of article packs emerging from the immediately upstream operations heretofore described. The assembly is generally characterized by paired drive or conveyor assemblies, namely, a first "upstream" pair 142 and a second "downstream" pair 144 as generally indicated FIG. 2. The first or upstream pair of conveyor assemblies 142 receive the initially associated article groups and article pack panels within the transfer station 130 whereupon article pack so formed advance to the second or downstream conveyor 144 from the transfer station 130. Upon transitioning from the transfer station 130 to the second conveyor 144, operations in furtherance in-line splitting or in-line splitting and tray formation commence.

As is generally well known, each conveyor assembly 142, 144 generally includes a transmission element 145, i.e., and endless loop, in the form of a belt, chain, etc., which advantageously carries lugs 147*a*, 147*b* or the like in spaced apart condition. The transmission element spans a pair of rollers, sprockets, etc. (not shown) for travel thereabout, one of which is selectively driven in furtherance of effectuating transmission element travel. In the present context, while the first or upstream pair of conveyor assemblies 142 are each characterized by a single transmission element 145, the second or downstream pair of conveyor assemblies 144 are each characterized by a set of transmission elements 145 extending in spaced apart condition in the direction of process flow (FIG. 5).

Notionally, as an article pack travels through transfer station 130, a merging article pack panel from the in-line panel conveyor portion 131 underlying the article infeed and metering stream is operatively received by the first or upstream conveyor 142. More particularly, a leading edge or edge portion of a tandem tray blank is abuttingly received by lugs 147*a* of the first conveyor 142, i.e., "downstream" or "leading" lugs, and, in the case of a tandem tray blank wherein a leading edge or edge portion thereof is configured as a tray end or sidewall (see e.g., FIG. 14 as to the former, and FIG. 20 as to the latter), intended engagement with the downstream lug forms an upstanding wall segment corresponding to and/or characterized by adjacent tray end or sidewalls. Moreover, upon incremental advancement of the initially formed tandem trays, opposing lateral flaps or tabs of what has become the upstanding wall segment are inwardly folded subsequent to engagement with guiderails or the like. Thereafter, during transition from the transfer station 130 to the in-line splitting station 126, lugs 147*b* of the second or downstream conveyor 144, i.e., "upstream" or "trailing" lugs, emerge so as to engage the trailing edge or edge portion of the article pack and thereafter advance the article pack for further in-line manipulations.

Figure 5:
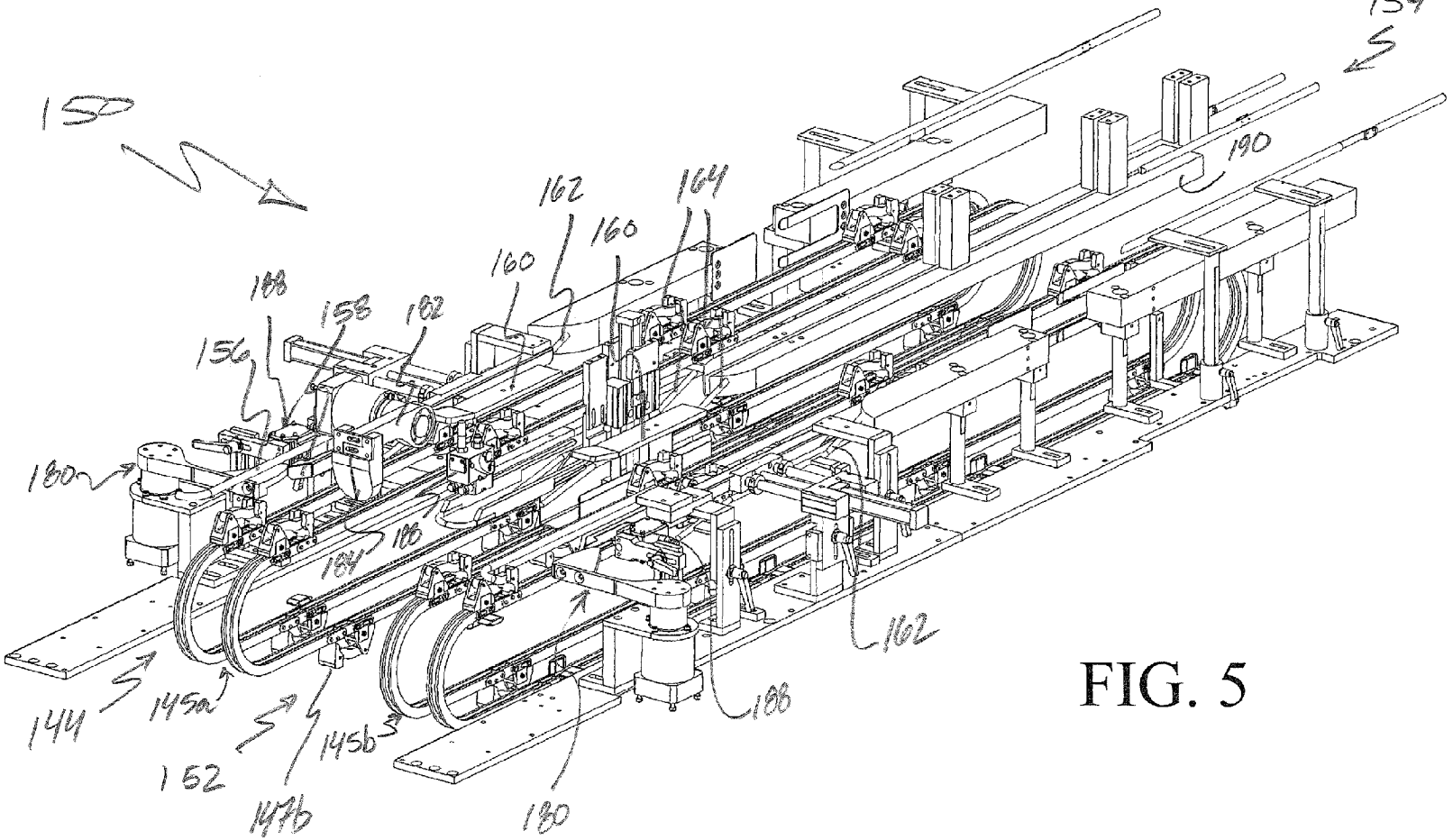
FIG. 5 depicts, perspective view slightly from above and process flow left to right, an assembly of the system of FIG. 3, namely, that associated with area "B" of FIGS. 2 & 4, more particularly, an assembly for article pack splitting and tray formation.
Figure 6:
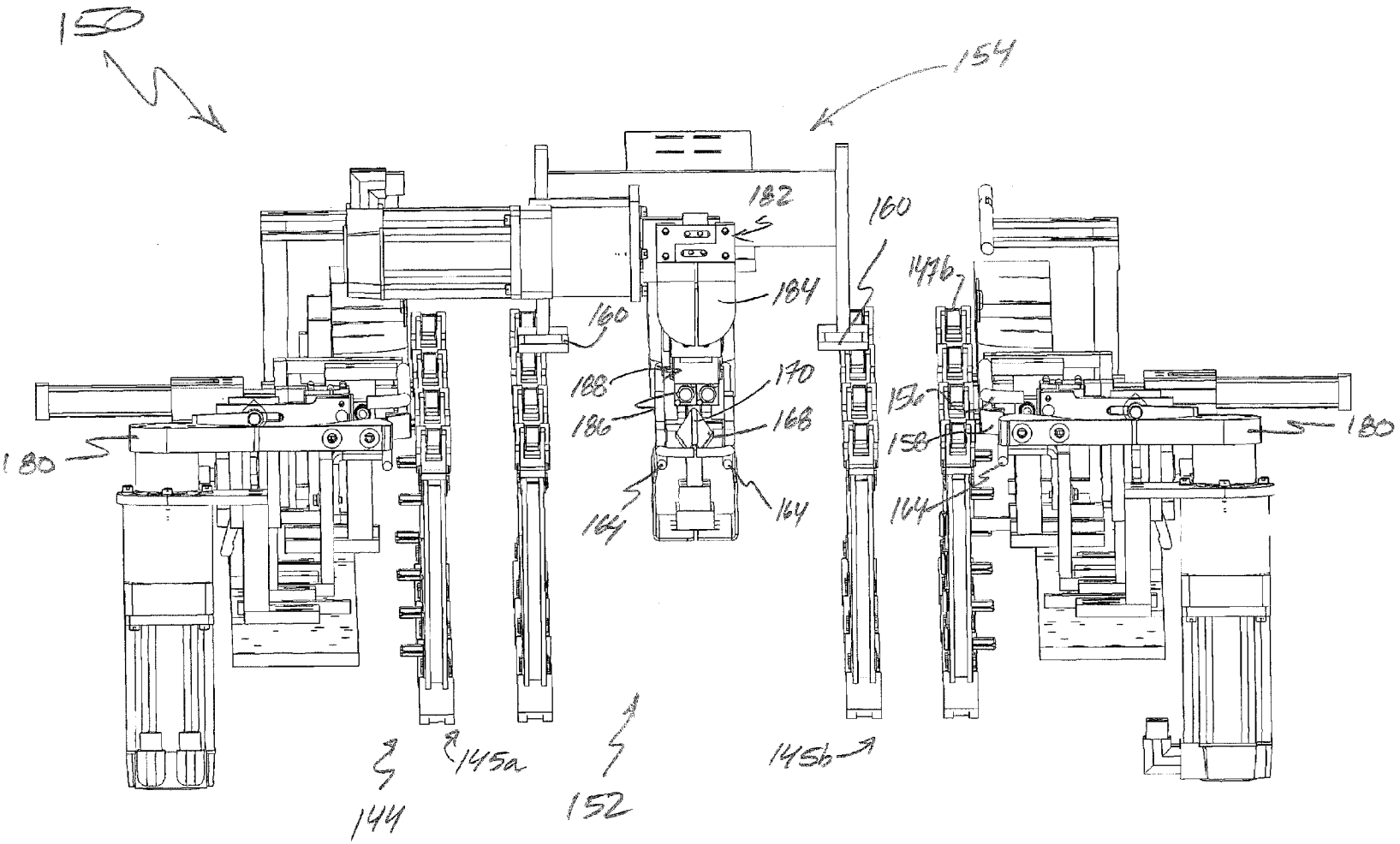
FIG. 6 depicts, upstream end view, the assembly of FIG. 5.
Figure 7:
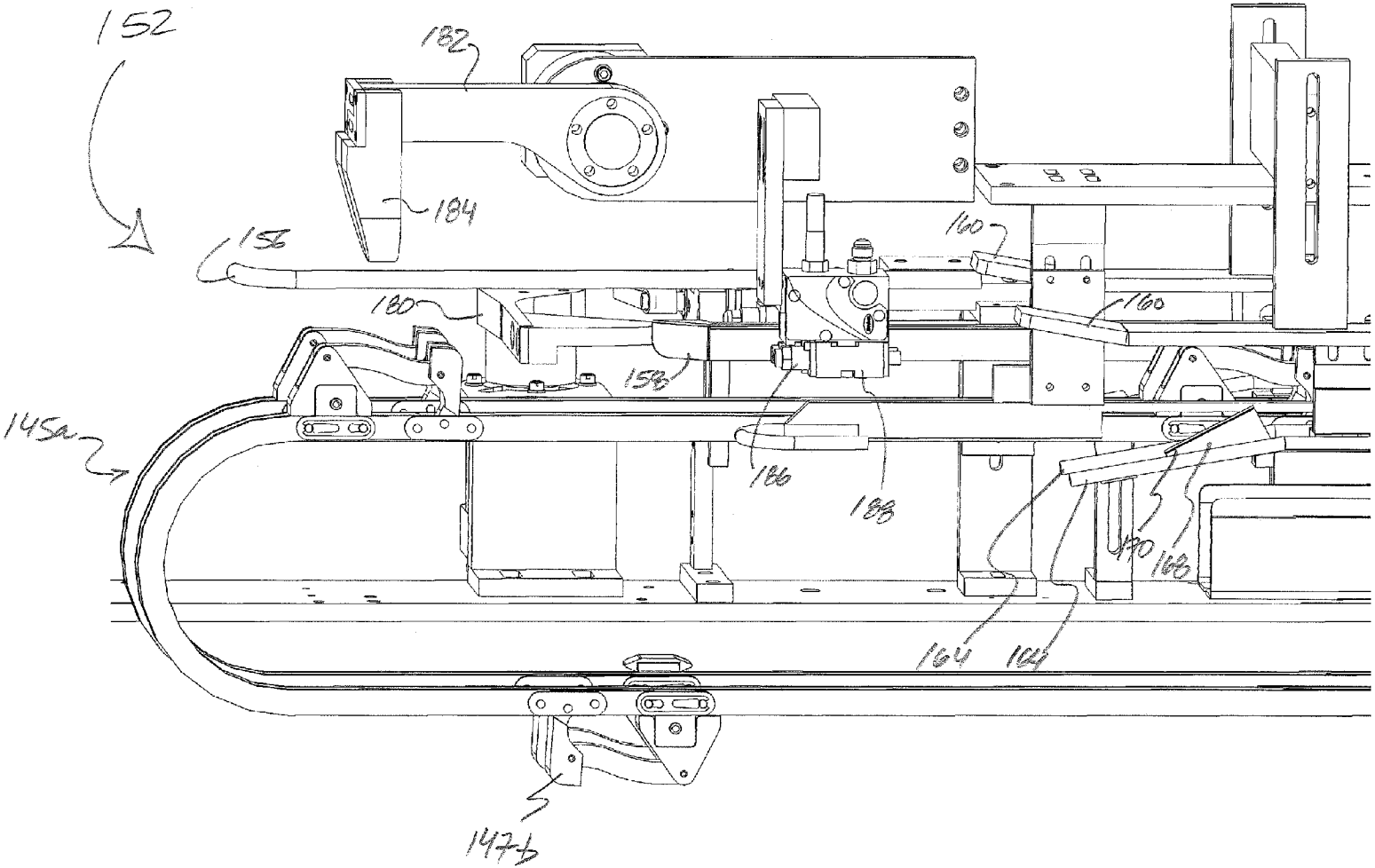
FIG. 7 depicts, side elevation, an upstream end portion of the apparatus of FIG. 5, parts removed to reveal underlaying detail(s), more particularly, an article pack splitting assembly and/or mechanism.

With reference now to FIGS. 5-7, an assembly 150 for in-line article pack splitting and tray formation is shown, namely, the assembly associated with portion "B" of FIG. 2 or FIG. 4 (i.e., a subassembly of the assembly delimited by "AA" thereof). At this processing juncture, the article pack enters a station or section delimited by the assembly/subassembly for engagement with trailing lugs 147*b* of the spaced apart second or downstream conveyors 145 of the second or downstream conveyor assemblies 144. A first set of transmission elements 145*a*, sheet left in either of FIG. 5 or 6, and a second set of transmission elements 145*b*, sheet right in either of FIG. 5 or 6, travel clockwise as shown such that a synchronously driven lug set for each transmission element of paired transmission elements catch or otherwise engage the trailing edge or edge portion of the article pack as the lugs transition from a "downward" facing orientation to an "upward" facing orientation. It is to be noted that the transmission elements 145 of the first or upstream conveyor assemblies 142 are not shown for the sake of clarity, however, as should be readily understood and appreciated, portions of the upstream transmission elements extend intermediate substantial segments of the transmission element sets 145*a*, 145*b* of the second or upstream conveyor pairs 144 (see e.g., FIG. 2).

The assembly generally includes an ingress portion 152 and an egress 154 portion opposite thereto. As depicted, the upstream and downstream limits of the second or downstream conveyor pairs 144 generally delimit the assembly ingress 152 and egress 154 portions. Preliminarily manipulated article packs, i.e., single article packs, enter via the ingress portion and split discrete article packs, characterized by fully formed trays and originating from the single article pack, exit from the egress portion for subsequent parallel bundling operations.

Characteristic of the assembly is a splitter in the form of a splitting head, flap tuckers and gluers, grouped article guides, tandem tray blank guides (i.e., tray side/end wall formers), and a spacer to selectively distance the split discrete article packs to aid subsequent processing, e.g., bundling operations. A brief discussion of the forementioned features follow.

As may be best appreciated in connection to the end view of the assembly ingress portion 152, FIG. 6, the passage width for article pack travel is generally delimited by longitudinally extending spaced apart grouped article guides, e.g., upper 156 and lower 158 rails as shown, with spaced apart overhead article group guides, e.g., bars 160 as shown, generally delimiting a article pack passage height. Moreover, passage width is regulated or selectively delimited by a series of spaced apart longitudinally extending tandem tray blank guides, e.g., rails 162 as shown, which function to form tray sidewalls as is the case with regard to the tandem tray blank of FIG. 14 or 15, or tray end walls as is the case with regard to the tandem tray blanks of, e.g., FIG. 20. Moreover, splitting head 168, advantageously characterized by a ridge or crest 170, more particularly, an upward sloping ridge in the direction of article pack flow (FIG. 7), is centrally disposed with respect to the article pack flow path downstream of actuatable flap tuckers 180 (FIG. 6).

Flap tuckers, more particularly, actuatable (e.g., pivotable) flap tuckers 180 are advantageously positioned as generally shown in FIGS. 5 & 6, and as partially shown in FIG. 7. Recalling that a split or divided article pack is formed via the instant assembly from a tandem tray blank, e.g., as either of FIG. 14 or 15, tray formation steps are undertaken both in advance of article pack splitting and subsequent to article pack splitting. Tandem tray blank manipulations, i.e., tray formation steps are hereinafter outlined in the context of sequentially operations upon the article pack.

In advance of splittable article pack splitting, downstream end wall formation (i.e., long side tandem tray blank manipulations/operations) proceeds via leading edge portion lugs 147*b* as previously noted, with associated adjacent flap tucking via passage of the article pack by/through a static tucker, e.g, a guide in the form of a rail portion. Via actuatable flap tuckers 180 opposingly supported adjacent the article pack flow path, flaps of the upstream trailing edge portion of the tandem tray blank, previously erected via the downstream lugs 147*a* of the upstream conveyor pair 142, are likewise tucked or folded via selective/synchronous activation. Moreover, further pre article pack splitting manipulations are carried out with respect to the trailing edge or trailing edge portion of the tandem tray blank, namely, a disassociation of adjacent flaps thereof.

Recalling that the tandem tray blank generally has a length "L" and a width "W," and a portrait orientation relative to the process flow direction, at least a trailing edge/trailing edge portion 46, generally delimited by relief areas 52 (i.e., a pair of lateral edge notches and a central cut-out as shown (e.g., FIG. 14), of the tandem tray blanks 32 comprise, in sequential arrangement, a tab, an end wall panel, a tab, a tab, an end wall panel and a tab (see e.g. FIG. 14). An overhead actuatable dual flap tucker 182, centrally disposed in relation to the article pack travel path and supported for select or synchronous pivoting/rotational engagement therewith, as by head 184, disassociates the adjacent central flaps of the trailing edge portion of the tandem tray blank which is, at this point, upstanding in relation to a tray base from which it is in hinged extension, and likewise folds each flap in a direction of article pack flow.

Thereafter, the splittable article pack advances for splitting via passage through the splitting head 168. More particularly, to the extent a four-sided tandem tray blank (FIG. 14) versus a three-sided tray blank (FIG. 15) is contemplated, the leading edge or leading edge portion of the tray blank previously erected via the trailing lugs of the upstream conveyor pairs, is acted upon by the splitting head so as to disassociate the adjacent central flaps thereof and fold each flap in a direction contrary to the article pack flow. Thereafter, with an axially alignment for and between a line-of-weakness extending from at least a leading edge of the tandem tray blank with the ridge of the splitting head, the splittable article pack further advances with splitting effectuated to split the article pack, for instance with reference to FIG. 14, from a twelve-article pack to two six-article packs. With the split propagating from a leading edge to a trailing edge, previously conjoined sidewall tray blank portions are disassociated and thus in a readied state for further final tray forming operations post splittable article pack splitting.

Subsequent to the initiation of splitting of the splittable article pack, advancement of each discrete article pack of the split article pack proceeds via the continued advancement of the downstream lugs of the first and second sets of upstream conveyor pairs. Each sidewall of the previously/otherwise conjoined sidewalls of the tandem tray blank are passed along tray blank guides as shown, namely, tray blank guides 164 which are spaced about the splitting head 168 of the splitter (FIG. 7). In manner similar to that associated with tray sidewall formation from opposing tray blank portions extending in the direction of splittable article pack flow (i.e., lateral or width edge portions as per FIG. 14), adjacent upstanding longitudinal or sidewalls are formed and adhesively united to/with lateral end flaps, adhesive having been applied to a sidewall engagement surface of each lateral flap by a gluer 186 of a gluing station 188 (FIG. 7). At this point, split tray packs advance toward the article pack bundling station V, with spacing adjustments made via a central spacer 190 or the like (FIG. 5) to establish/maintain an advantageous spacing, travel spacing between the split article packs, for combined wrapping in furtherance of bundling.

Split article packs are conveyed/transferred from the article pack splitting and tray forming section or station IV, and to the article pack bundling station V, more particularly, to a wrapping table or system 192 thereof characterized by a wrapping conveyor 194 and an actuatable wrap bar 196, advantageously, but not exclusively or necessarily, a film wrapping system as shown and disclosed in U.S. Publ. No. US2011/0214397 (Floding et al.) entitled APPARATUS, SYSTEM & METHOD FOR ADJUSTABLE WRAPPING, incorporated herein by reference in its entirety. Moreover, while instructive though not believed necessary, attention is likewise directed to the teaching of WO 2011/133832 (Floding et al.) entitled APPARATUS AND METHODS FOR PRODUCING SHRINK-WRAP PACKAGING, incorporated herein by reference in its entirety for advantageous, non-limiting particulars. Notionally, in the context of the establishment of split article packs, a film sleeve is formed about the conveyed pair in the direction of split article pack travel.

Film, from a supply of film is advanced for engagement with the conveyed/transferred split article packs, advantageously from below the flow of article packs and in a manner not inconsistent with article pack panel advancement relative to the flow of metered, metered and grouped articles ongoing at an upstream local. In addition to sheeting of the film (i.e., cutting in a direction perpendicular to film flow), perfing of the advancing film (i.e., the establishment of a line-of-weakness in the direction of film flow) is conducted in furtherance of forming a splittable film wrapper, namely, a split wrapper or wrapping owing to subsequent shrinking operations in a heating tunnel 198 of the bundling station, for the jointly wrapped split article packs. Illustrative, non-limiting particulars for such processes are shown and described in U.S. Pat. No. 7,032,360 (Rutten et al.) entitled APPARATUS AND METHODS FOR PRODUCING SHRINK WRAP PACKAGING, U.S. Pat. No. 7,328,550 (Floding et al.) entitled METHOD FOR PACKAGING ARTICLES USING PRE-PERFORATED HEAT SHRINK FILM, and U.S. Pat. No. 7,849,770 (Floding et al.) entitled FILM CUTTER, each teaching incorporated herein by reference in its entirety. Notionally, the co-wrapped or sleeved article packs proceed to a wrap shrinking apparatus, e.g., heat tunnel 198 or the like as indicated (FIG. 1), wherein thermal treatment of the wrapped article packs effectuates a film sleeve shrinkage and splitting along the line-of-weakness, resulting in separate bundling of each of the article packs.

Figure 9:
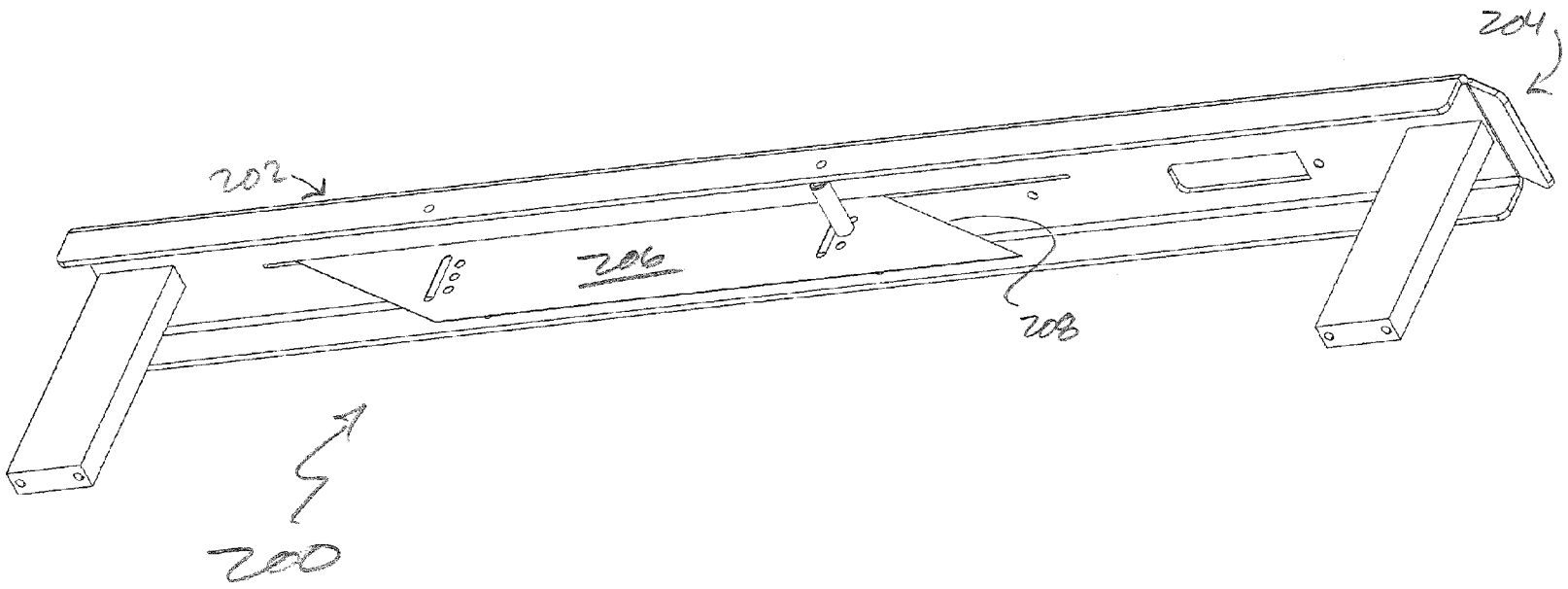
FIG. 9 depicts the assembly of FIG. 8, slightly from below.
Figure 10:
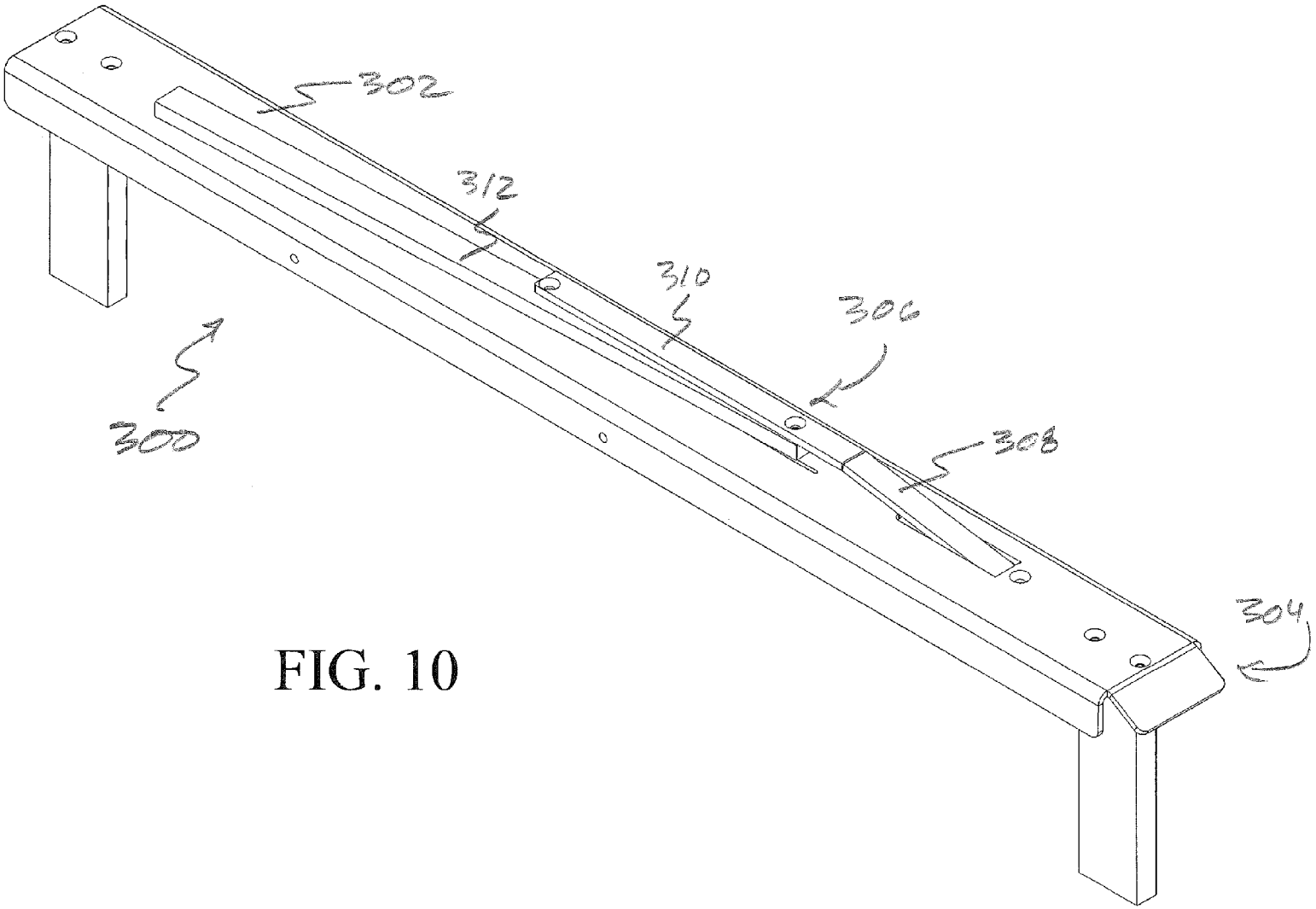
FIG. 10 depicts, perspective view slightly from above and process flow right to left, a further contemplated article pack splitting assembly.
Figure 11:
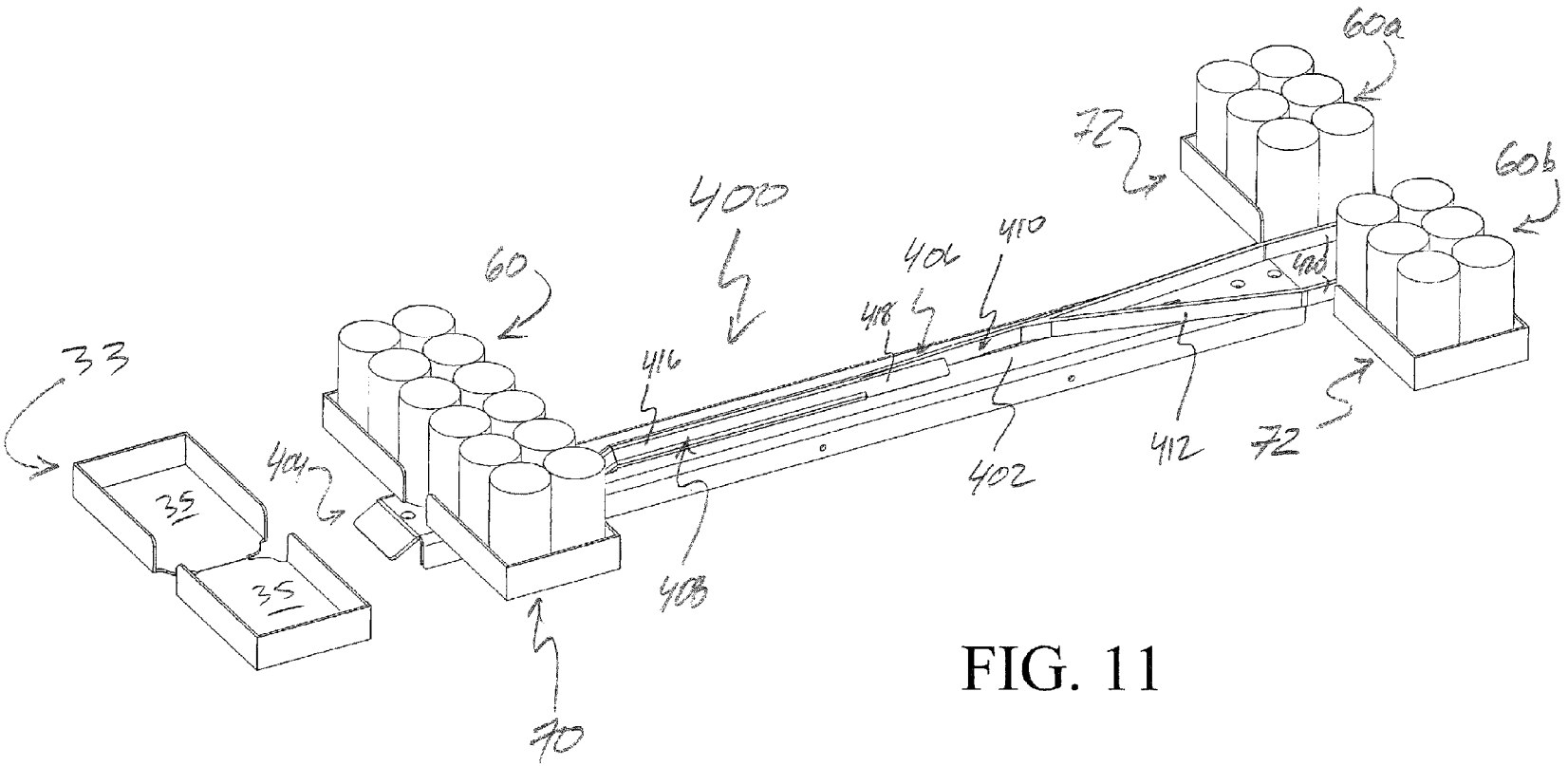
FIG. 11 depicts, perspective view slightly from above and process flow left to right, a further contemplated article pack splitting assembly with a splittable and split articles pack shown, along with a tandem tray of the splittable article pack.
Figure 12:
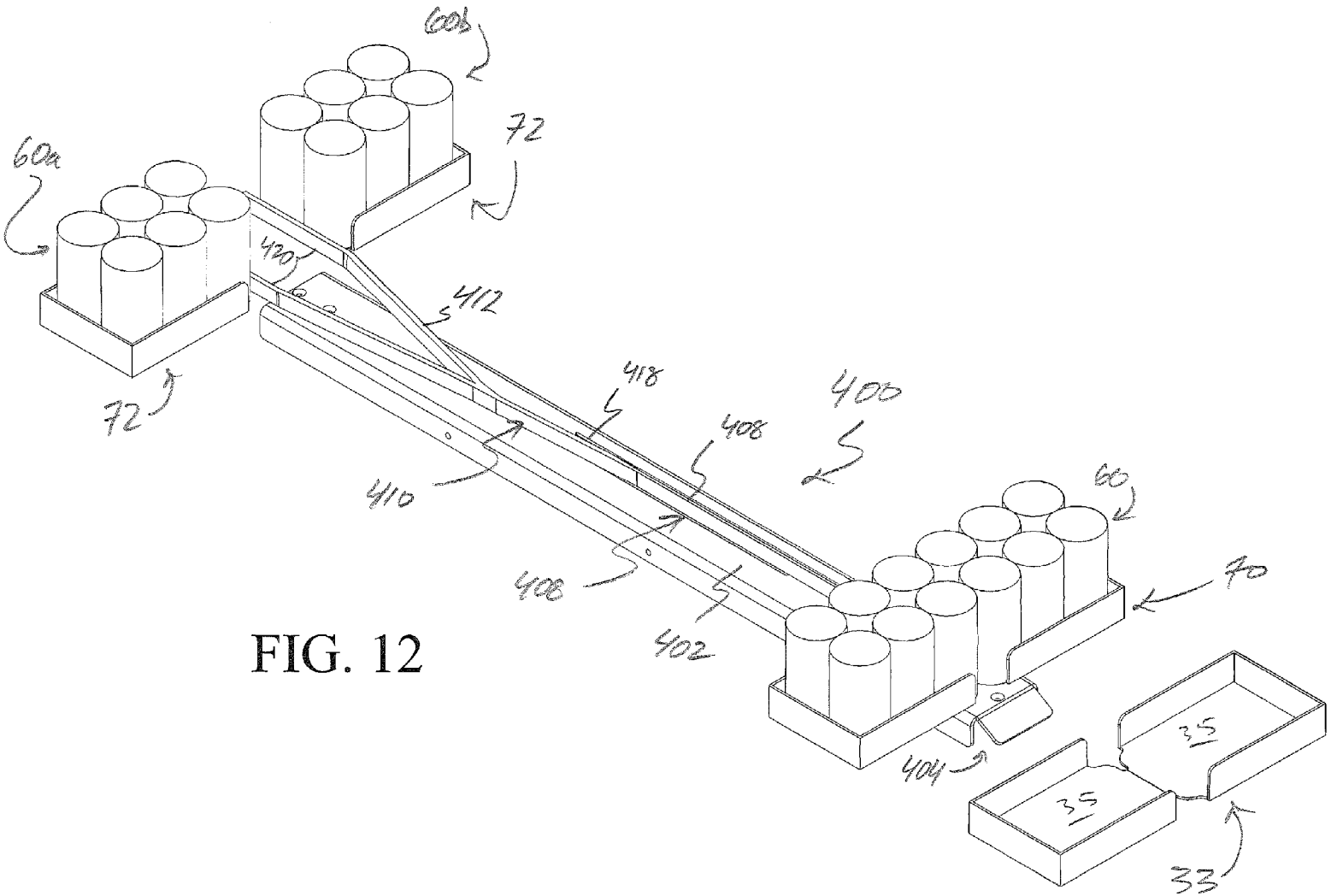
FIG. 12 depicts, in an opposite view, the assembly and elements of FIG. 11.

Having generally provided an overview of the process, and a description of attendant systems, assemblies, subassemblies, mechanisms, etc. to effectuate various and sundry operations of the process, reference is now made to the assemblies or structures of FIGS. 8-13. Generally, alternate splitting means are depicted, namely, mechanisms characterized by a blade or blade like element (FIGS. 8 & 9), a ramp (FIG. 10), and an angled (i.e., canted) ramp (FIGS. 11-13).

Figure 8:
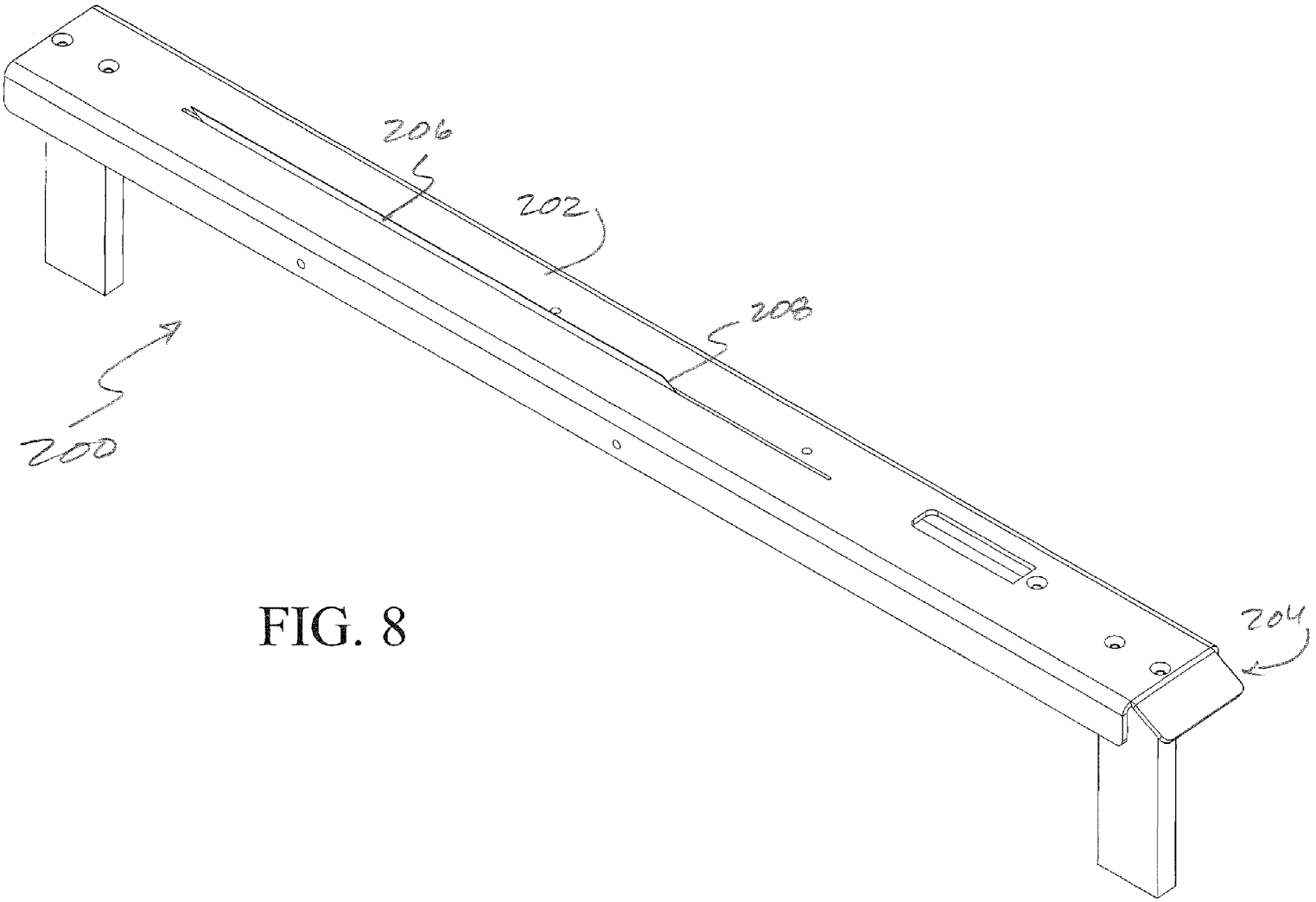
FIG. 8 depicts, perspective view slightly from above and process flow right to left, a further contemplated article pack splitting assembly for flow splitting operations.

With particular reference to assembly 200 as depicted in the views of FIGS. 8 & 9, a stage or platform 202 characterized by a ramped ingress 204 is generally provided for receipt of a splittable article pack. Disposed so as to upwardly extend from the article pack platform 202 is a blade or blade like element 206. Advantageously, but not necessarily, the blade 206 includes a ramped end portion, namely, an angled or sloped/sloping leading end portion 208 for initial engagement with the splittable article pack. Moreover, it is contemplated that the blade be replaceable and adjustable, both with regard to height and fore/aft positioning relative to the platform.

Notionally, the splittable article pack is advanced for urged engagement upon and through the blade. In as much as it is desirable to utilize an article pack characterized by a line-of-weakness or the like and to axially align the line-of-weakness of the article pack panel of the splittable article pack with the blade so as to effectuate a sure and reliable splitting, an unaltered or non-weakened article pack panel may be suitably split via the blade of the subject assembly. Thereafter, further processing steps, e.g., article pack bundling, commence.

With particular reference to assembly 300 of FIG. 10, a stage or platform 302 characterized by a ramped ingress 304 is likewise generally provided for receipt of a splittable article pack. In lieu of a blade or blade like element, a guide 306 extends along and over the stage or platform 302. The guide is characterized by a forward ramp portion 308, and intermediate portion or segment 310 extending therefrom, and a downstream most rail segment 312 which underlies intermediate portion 310, and extends therefrom at a slight angle.

Notionally, a splittable article pack, advantageously characterized by an article pack including a line-of-weakness or the like, advances to and upon the guide such that an elevation change for a portion of the splittable article pack, in the vicinity of the line-of-weakness of the article pack panel, relative to the remainder of the article pack, effectuates a splitting of the article pack along the line-of-weakness. Upon propagation of the split during travel along the ramp and intermediate portions of the guide, a split discrete article pack of the split article pack commences engagement with the angle rail segment of the guide to effectuate an increase in a spacing for and between the discrete article packs originating from the splittable article pack. Thereafter, further processing steps, e.g., article pack bundling, commence.

With particular reference to assembly 400 as depicted in the views of FIGS. 11-13, a stage or platform 402 characterized by a ramped ingress 404 is further likewise generally provided for receipt of a splittable article pack. In the several views, representative tandem trays 33, article packs 70 characterized by representative tandem trays 33, and split article packs 72 characterized by a tray 35 of representative tandem trays 33 are generally shown.

As in the aforementioned alternative, in lieu of a blade or blade like element, a guide 406 extends along and over the stage or platform 402. As best appreciated in connection to the view of FIG. 13, the guide 406 is characterized by an initial or first linear segment or portion 408, a second linear segment 410 angularly extending from first linear segment 408, and a third linear segment or portion 412 angularly extending from second linear segment 410. The first linear segment 408 includes a ramp portion 414 upwardly extending from the stage 402 to initially receive and elevate an article pack portion so engaged, an angled (i.e., canted) segment 416 to facilitate propagation of a split of the splittable article pack, and a further optional ramp portion 418 to return the previously elevated and sloped article pack portion to the stage or platform. Each of the second 410 and third 412 linear segments include free end portions 420 which delimit spaced apart parallel guide segments intended to reestablish a parallel spaced apart condition for discrete article pack having origins in the splittable article pack so split.

Notionally, a splittable article pack, advantageously characterized by an article pack including a line-of-weakness or the like, advances to and upon the guide, namely, the ramp portion of the first linear segment of the guide, such that an elevation change for a portion of the splittable article pack, in the vicinity of the line-of-weakness of the article pack panel, relative to the remainder of the article pack, is achieved, thereafter, the elevated portion transitions to and through the angled segment of the first linear segment of the guide so as to effectuate a splitting of the article pack along the line-of-weakness. Upon propagation of the split during travel along the canted segment of the first linear segment of the guide, a first split discrete article pack of the split article pack commences engagement with the second linear segment angularly extending from the first linear segment, with the second split discrete article pack of the split article pack returning to the platform or stage for guided travel across the stage via the third linear guide segment. Each split discrete article pack of the split article pack subsequently travels to and past free end portions of each of the second and third linear guide segments to establish a spaced apart parallel travel path for the split article packs. Thereafter, further processing steps, e.g., article pack bundling, commence.

While advantageous, non-limiting systems, apparatus, assemblies, devices, mechanisms, methods, etc. relating to a split or splittable article pack, and more particularly, to the in-line formation of a splittable article pack characterized by grouped articles and an associated article pack panel are depicted, described and/or readily ascertained with reference to the instant disclosure, alternate not insubstantial functional equivalents are likewise contemplated to effectuate a sought after on-the-fly formation of a split or splittable article pack for retail ready handling. Presently known and future developed means for effectuating the noted functionalities are understood to be within the scope of the instant disclosure.

Thus, since the structures of the assemblies/mechanisms disclosed herein may be embodied in other specific forms without departing from the spirit or general characteristics thereof, some of which forms have been indicated, the embodiments described and depicted herein/with are to be considered in all respects illustrative and not restrictive. Moreover, while nominal processing has be described and detailed, and to some degree alternate work pieces and systems, assemblies, etc. shown with regard thereto, contemplated processes are not so limited. Accordingly, the scope of the subject invention is as defined in the language of the appended claims, and includes not insubstantial equivalents thereto.

We claim:

1. A continuous process of forming discrete trayed article subgroups originating from a trayed article group, the process comprising:

(a) providing a supply of tray blanks, said blanks characterized by a panel for receipt of articles, said panel characterized by adjacent first and second tray bases;

(b) providing a continuous flow of articles in an article flow direction;

(c) imparting a line-of-weakness through and across tray blanks dispensed from said supply of tray blanks, said line-of-weakness extending from a leading edge to a trailing edge of the tray blank and intermediate said adjacent first and second tray bases;

(d) selectively metering articles of said continuous flow of articles to form a single group of metered articles for in-line introduction of said single group of metered articles to a tray blank characterized by a line-of-weakness traveling in said article flow direction;

(e) introducing said single group of metered articles to said tray blank characterized by a line-of-weakness so as to delimit a paneled article group, said single group of metered articles comprising first and second article subgroups, said first article subgroup received upon a first tray base of said adjacent tray bases of said panel, said second article subgroup received upon a second tray base of said adjacent tray bases of said panel; and, (f) splitting said paneled article group along said line-of-weakness through and across said tray blank so as to delimit discrete paneled article subgroups downstream advancement of said paneled article group to and over an in-line ramped surface proximate said line-of-weakness through and across the tray blank of said paneled article group so as to tensioningly separate first and second article subgroups from one another along said line-of-weakness.

2. The continuous process of claim 1 wherein manipulations are performed on said tray blank characterized by a line-of-weakness of said paneled article group in furtherance of walled tray formation.

3. The continuous process of claim 1 wherein manipulations are performed on said tray blank characterized by a line-of-weakness of said paneled article group in furtherance of walled tray formation in advance of splitting.

4. The continuous process of claim 1 wherein manipulations are performed on said tray blank characterized by a line-of-weakness of said paneled article group in furtherance of walled tray formation subsequent to splitting.

5. The continuous process of claim 1 wherein manipulations are performed on said tray blank characterized by a line-of-weakness of said paneled article group in furtherance of walled tray formation prior to and after splitting.

6. The continuous process of claim 1 wherein manipulations are performed on split tray blank portions of each of said discrete paneled article subgroups in furtherance of walled tray formation.

7. The continuous process of claim 1 further comprising manipulating split tray blank portions of each of said discrete paneled article subgroups in furtherance of walled tray formation, and thereafter film wrapping of trayed article subgroups so formed.

8. The continuous process of claim 1 further comprising in-line encoding of portions of said tray blank in advance of in-line introduction of said single group of metered articles to a tray blank characterized by a line-of-weakness.

9. The continuous process of claim 1 further comprising in-line encoding of opposing portions of said tray blank in advance of in-line introduction of said single group of metered articles to a tray blank characterized by a line-of-weakness.

10. The continuous process of claim 1 wherein said tray blanks are configured to form four-sided trays.

11. The continuous process of claim 1 wherein said tray blanks are configured to form three-sided trays.

12. The continuous process of claim 1 wherein said tray blanks are configured to form two-sided trays.

13. The continuous process of claim 1 wherein said tray blanks are configured to form sideless trays.

14. The continuous process of claim 1 wherein said line-of-weakness comprises a perforation line.

* * * * *